US011619468B2

(12) United States Patent
Grace

(10) Patent No.: US 11,619,468 B2
(45) **Date of Patent: *Apr. 4, 2023**

(54) MACRO ALIGNMENT RETICLE SIGHT SYSTEM

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/579,057

(22) Filed: Jan. 19, 2022

(65) Prior Publication Data

US 2022/0146230 A1 May 12, 2022

Related U.S. Application Data

(63) Continuation of application No. 16/780,262, filed on Feb. 3, 2020, now Pat. No. 11,287,220, which is a continuation-in-part of application No. 16/749,153, filed on Jan. 22, 2020, now Pat. No. 11,262,164.

(60) Provisional application No. 62/885,549, filed on Aug. 12, 2019, provisional application No. 62/871,413, filed on Jul. 8, 2019, provisional application No. 62/806,214, filed on Feb. 15, 2019.

(51) Int. Cl.

| | |
|---|---|
| ***F41G 1/30*** | (2006.01) |
| ***F41G 1/54*** | (2006.01) |
| ***F41G 1/34*** | (2006.01) |

(52) U.S. Cl.
CPC ..... *F41G 1/545* (2013.01); *F41G 1/30* (2013.01); *F41G 1/345* (2013.01)

(58) Field of Classification Search
CPC ..... F41G 1/30
See application file for complete search history.

(56) References Cited

U.S. PATENT DOCUMENTS

| | | | | |
|---|---|---|---|---|
| 6,252,706 | B1 | 6/2001 | Kaladgew | |
| 7,171,776 | B2 | 2/2007 | Staley, III | |
| 10,234,238 | B1 | 3/2019 | Thomas et al. | |
| 2013/0152447 | A1 | 6/2013 | Ostergren et al. | |
| 2018/0128574 | A1* | 5/2018 | Crispin | G02B 23/105 |
| 2019/0285381 | A1 | 9/2019 | Hahn | |
| 2020/0025515 | A1* | 1/2020 | Thomas | F41G 3/08 |
| 2020/0025518 | A1 | 1/2020 | Nackel et al. | |
| 2021/0207926 | A1* | 7/2021 | Mikroulis | F41G 1/30 |

* cited by examiner

*Primary Examiner* — Gabriel J. Klein
(74) *Attorney, Agent, or Firm* — Warner Norcross + Judd LLP

(57) ABSTRACT

An aiming device is provided including an illumination device and an optical element wherein the illumination device projects a primary dot and at least one secondary alignment dot distal from the primary dot to aid a user in obtaining a view of the primary dot when the aiming device is in an aligned mode, the primary dot is visible within a field of view of the user, but the secondary alignment dot is not visible. When the aiming device is in a misaligned mode, the secondary alignment dot is visible to the user, but the primary dot is not. The secondary alignment dot provides instruction to the user to realign the aiming device relative to the field of view of the user so that the aiming device transitions to the aligned mode. A related method of operation is provided.

16 Claims, 15 Drawing Sheets

MACRO ALIGNMENT RETICLE SIGHT SYSTEM

BACKGROUND OF THE INVENTION

The present invention relates to aiming devices, and more particularly to reflex aiming devices having a macro alignment reticle or other reticle alignment aids.

The popularity and use of firearms for hunting, target shooting, and other dynamic shooting sports, has increased over the past several decades. The fast-paced, competitive nature of shooting and the desire by hunters to have well-placed, ethical shots, have led to the development and commercialization of a variety of aiming devices. These devices include fiber optic sights, illuminated scope reticles and reflex sights, to name a few.

Reflex sights typically are used with firearms in a variety of shooting sports and hunting activities where quick target acquisition is favorable. Such sights superimpose a bright illuminated dot against a center of a lens or window in a protective frame. The firearm is aimed by placing the superimposed dot on a target as viewed through the window. Due to the centering of the dot in the window, and in particular, at a central focal point on the window, the window and superimposed dot are both usually centered on the target.

Reflex sights have recently become more popular on handguns. Handguns are smaller than long guns, such as rifles, and thus smaller sights are favored. In many present handgun reflex sights, the superimposed dot typically is generated by a small light emitting diode disposed at the focal point the lens, which is selectively reflective to the wavelength of the illumination. The focal point of most reflex sight lenses is usually located at the geometric center of the lens. These sight lenses also are rather small, sometimes less than one square inch in area.

An issue with many reflex sights, in particular smaller ones, such as those used on handguns, is that the superimposed dot is only visible when the sight and lens are at a particular orientation relative to a use in a user's field of view. For newer users, achieving this alignment can be difficult to do, particularly if the user is attempting to quickly align the sight on a target. For example, when a user raises a firearm from a lowered position or ready position to an aiming position, their goal is to quickly and consistently acquire or view the superimposed dot on the lens, then move that dot over a target. Due to the orientation of the firearm and sight, in some cases, the user might not be able to see the dot on the lens, which can be frustrating. As a more particular example, a user might raise a firearm, with a reflex sight mounted thereon, upward to what they perceive as a proper aiming position. Due to the gun, and thus the sight, being angled too far forward, backward, or too far to a side, the user cannot physically see the dot on the lens—even though the dot is still being projected by the diode on the lens. The lens is simply at the wrong angle for the user to actually see or view the dot in this misaligned configuration of the firearm and sight.

When this misalignment occurs, the user must first understand that the dot is there (not that the sight is malfunctioning), second, realign the sight so that the dot becomes visible to them on the lens, and third, align the dot with the target and engage the firearm to accurately fire a shot. However, newer users and some experienced users with poor eyesight may not perceive which direction is the proper one to move toward and gain visibility of the apparently hidden dot. Accordingly, the user might pan the gun left/right and up/down several times until they figure out how to gain visibility of the dot on the lens. This can be frustrating and time consuming, particularly in competition. It also can create a dangerous situation if the user moves the gun barrel in an unsafe direction while trying to find the dot on the lens. Again, this can in some cases make target alignment and acquisition more difficult and time consuming.

Accordingly, there remains room for improvement in the field of aiming devices, particularly with regard to reflex sights to improve the aiming dot perception and enhance target acquisition.

SUMMARY OF THE INVENTION

An aiming device is provided in the form of a reflex sight having a primary dot as well as secondary alignment dots that are hidden from view when the primary dot is properly aligned in a normal field of view, but that become exposed to provide visual, instructive feedback when the sight is misaligned so a user can properly align the primary dot, for example, with a target.

In one embodiment, the aiming device or sight can include a body and a frame joined with the body. The frame can house an optical element configured to reflect and/or display to a viewer one or more of a dot, mark, indicia, sight element, reticle pattern, arrow element, illuminated element and/or direction pointer (all of which are referred to as a "dot" herein) in a projection region, and/or superimposed relative to the optical element in some cases.

In another embodiment, there can be several dots in a dot pattern (which includes two or more dots) in the projection region and/or displayed via the optical element. For example, there can be a primary dot, which itself is configured to be aligned with a target to thereby align a weapon with the target to fire on the target and engage the target. There also or alternatively can be at least one secondary alignment dot which itself is not aligned with the target, but instead is used to provide instruction to a user to move, angle or otherwise reorient the aiming device so the user can better view or attain visibility of the primary dot in a field of view, such that the user can then align the primary dot with the target to engage it.

In still another embodiment, the aiming device can project a primary dot and at least one secondary alignment dot distal from the primary dot simultaneously in a projection region that overlaps the optical element. The projection region can extend beyond the optical element so when the aiming device is in an aligned mode, the primary dot is visible within a field of view of the user, but the secondary alignment dot is not visible.

In yet another embodiment, when the aiming device is in a misaligned mode, the secondary alignment dot is visible to the user, but the primary dot is not. The secondary alignment dot can provide instruction to the user to realign the aiming device relative to the field of view of the user so that the aiming device transitions to the aligned mode.

In even another embodiment, the secondary alignment dot can be in the form of arrow or pointer element pointing in a direction of movement of a muzzle of a weapon to which the aiming device is attached. When a user moves the muzzle in the direction pointed to by the arrow element in the misaligned mode, the primary dot becomes visible or more visible to the user. The user can then acquire or better acquire a view of that primary dot and align it with a target to thereby align the weapon with the target and engage the target.

In a further embodiment, the sight can be configured so that the primary dot is displayed on the optical element, which can be constructed from and/or include glass, polymer, crystal or other light transmissive or reflective materials or coatings.

In still a further embodiment, an illumination device can project the primary dot and a plurality of secondary alignments dot distal from the primary dot simultaneously in the projection region that overlaps the optical element. The projection region can extend beyond the edges of the optical element such that when the aiming device is in an aligned mode, the primary dot is visible in a field of view of the user, but the secondary alignment dots are not visible to the user within the field of view of the user. Thus, the user can be assured that the primary dot is properly aligned in their field of view so they can aim the aiming device and associated weapon via the primary dot.

In yet a further embodiment, the primary dot can include a primary viewing axis or optical axis that projects rearward from the optical element when the primary dot is visible in the field of view. The primary viewing axis or optical axis can be generally aligned with a first viewing axis of the user in the field of view when the aiming device is in the aligned mode, such that the primary dot is visible to the user within the field of view of the user. The secondary alignment dots are not visible to the user when the aiming device is in the aligned mode, because the at least one secondary alignment do is distal from the primary viewing axis such that the secondary alignment dots are out of the field of view in the aligned mode.

In even a further embodiment, the optical element can include an upper edge, a lower edge a left edge and a right edge. The secondary alignment dot can include an upper alignment dot projected beyond the upper edge, a lower alignment dot projected beyond the lower edge, a left alignment dot projected beyond the left edge, and a right alignment dot projected beyond the right edge.

In another further embodiment, the secondary alignment dots can be in the form of arrow elements. Each of the arrow elements can point away from the primary dot.

In still another further embodiment, the primary dot can be of a different wavelength or color than the secondary alignment dots. A user can thus distinguish between the primary dot and the secondary alignment dot so as to not inadvertently aim the aiming device using the secondary alignment dots aligned with a target.

In yet another, further embodiment, where there are multiple secondary alignment dots arranged around the outside perimeter of the projection region, certain secondary alignment dots may be displayed, while others are not, when the aiming device is in the misaligned mode. For example, a lower alignment dot can be visible to the user, but the upper alignment dot is not visible to the user within the field of view, or vice versa, when the aiming device is in the misaligned mode. As another example, the right alignment dot can be visible to the user, but the left alignment dot is not visible to the user within the field of view, or vice versa, when the aiming device is in the particular misaligned mode.

In another embodiment, a method of operating an aiming device is provided. The method can include projecting a primary dot and at least one secondary alignment dot distal from the primary dot simultaneously in a projection region that overlaps an optical element having at least one edge, the projection region extending beyond the edge of the optical element; and making the primary dot visible to a user within a field of view of the user, but the at least one secondary alignment dot is not visible to the user within the field of view of the user, when the aiming device is in an aligned mode.

In still another embodiment, the method can include making the at least one secondary alignment dot visible to the user within the field of view of the user, but the primary dot not visible within the field of view of the user, when the aiming device is in a misaligned mode. The visible secondary alignment dot can provide instruction to the user to align or realign (which terms are used interchangeably herein) the aiming device relative to the field of view of the user.

In another embodiment, the optical element can be housed in a frame such that the dot can be viewed by a user along a first viewing axis. One or more secondary alignment dots can be located on the frame or a body of the sight, at a location distal from the optical element and the dot. The secondary alignment dots can be in the form of illuminated elements, such as lights that are visible on an exterior of the frame and/or the body.

In a further embodiment, the illuminated elements forming the secondary alignment dots can be in the form of a lights, such as a light emitting diodes, or some other type of light. The illuminated elements can include a cover or lens having an arrow, pointer or other indicia, which can be of a color different from a color of the primary dot so as to let a user know when they are viewing the secondary alignment dots to assist in alignment rather than an actual primary dot for aiming.

In still a further embodiment, the secondary alignment dots, in the form of illuminated elements, can be located on portions of the sight that is distal from the rear of the sight, for example, on a side, top, front or bottom of the sight body and/or frame. In this location, the secondary alignment dots can be obscured and generally not visible when a user is viewing the rear of the sight, and/or the first viewing axis to view the dot, or the user is aligned with the optical axis to view the dot in an aligned mode. On the other hand, when the aiming device is in a misaligned mode, one or more secondary alignment dots are visible to the user, but the primary dot is not. The one or more secondary alignment dots can provide instruction to the user to realign the aiming device relative to the field of view of the user so that the aiming device transitions to the aligned mode, with the primary dot visible to the user.

In even another embodiment, the secondary alignment dot can be in the form of an illuminated element with an arrow or pointer element pointing in a direction of movement of a muzzle of a weapon to which the aiming device is attached. When a user moves the muzzle in the direction pointed to by the arrow element in the misaligned mode, the primary dot becomes visible or more visible to the user. The user can then acquire or better acquire a view of that primary dot along an optical axis and align it with a target to thereby align the weapon with the target and engage the target.

In yet a further embodiment, the secondary alignment dots can be situated relative to the frame and/or body such that they are individually visible from one or more second viewing axes or alignment axes that are each offset or different from the first viewing axis and optical axis of the optical element. Thus, a user viewing the primary dot along the first viewing axis or along the optical axis will not view the primary dot and secondary alignment dots simultaneously. The user viewing along the first viewing axis, generally parallel to the optical axis or within a range of angles offset relative to the same, will not be able to view the second viewing axis and will not see the secondary alignment dots.

In even a further embodiment, the first viewing axis or optical axis is offset from the one or more second viewing axes by a predetermined angle. The primary dot is visible to the user viewing along a first viewing axis when the sight is in a first orientation relative to the user in an aligned mode, while the one or more second viewing axis and an associated secondary alignment dot is visible to the user when the sight is in a second orientation relative to the user in a misaligned mode. For example, when the sight is in an orientation such that the rear of the sight is viewable by the user, the first viewing axis, which can be aligned generally with the optical axis, also is viewable, but the second viewing axis is not. Thus, the primary dot is viewable but the secondary alignment dot is not. When the sight is in an orientation such that the left or right side of the sight is viewable by the user, the second viewing axis is viewable but the first viewing axis, aligned somewhat with the optical axis, is not. Thus, the secondary alignment dot is visible but the primary dot is not viewable or only slightly visible in the user's field of view.

In another, further embodiment, the secondary alignment dot can be inset in a recess defined by at least one of the body and the frame. The recess can be configured with a recess longitudinal axis or bore axis that is angled relative to the first viewing axis and/or the optical axis. When the secondary alignment dot is in the form of or includes an illuminated element, when illuminated, that element is not visible to the user when the user is viewing the primary dot in the user's field of view when the aiming device is in an aligned mode.

The current embodiments of the aiming device provide benefits in shooting sports and hunting that previously have been unachievable. For example, where the aiming device or sight includes secondary alignment dots that are normally hidden, those dots do not impair or interfere with aiming of the primary dot or alignment of the same with a target. However, when the primary dot is insufficiently visible or not visible in a user's field of view, the secondary alignment dots become visible to provide visual instruction or direction to the user so that the user can reorient, move or realign the aiming device and the weapon to which it is attached to again acquire a satisfactory or full view of the primary dot, which the user can then align with a target to engage the same. The aiming device can provide rapid and efficient visual feedback to a user to help align the primary dot. This can save time in aiming the device and an associate weapon. It also can prevent frustration when the user is unfamiliar or unpracticed with the aiming device, helping them to quickly move and acquire visibility of the primary dot in their field of view.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the aiming system, also referred to as a sight herein is illustrated in FIGS. 1-10 and generally designated 10. To begin, the sight 10 is shown mounted on a semi-automatic pistol. The sight 10 can, however, be mounted on other types of projectile shooting devices. For example, it can be mounted to other types of firearms, including but not limited to a rifle (for example, a long rifle, a carbine, an assault rifle, a bolt pump rifle or a battle rifle); a shotgun (of any gauge) and/or a machine gun (for example, a machine pistol, a light machine gun, a mini gun, a medium machine gun or a heavy machine gun). The firearm can include any type of action, for example, bolt action, lever action, pump action and/or break action. The firearm can be single shot, automatic and/or semiautomatic. Further optionally, the firearm can be in the form of a vehicle-mounted weapon, mounted directly to the vehicle, a watercraft or other mode of transportation of course. As used herein, firearm can also include cannons, howitzers, handheld rocket launchers and similar weaponry, as well as equipment such as paint ball markers and air rifles such as bb guns, air soft guns and/or pellet guns. The projectile shooting device alternatively can be in the form of an archery bow, including but not limited to a compound bow, a recurve bow, a crossbow, or other device from which arrows or bolts can be shot.

Figure 1:
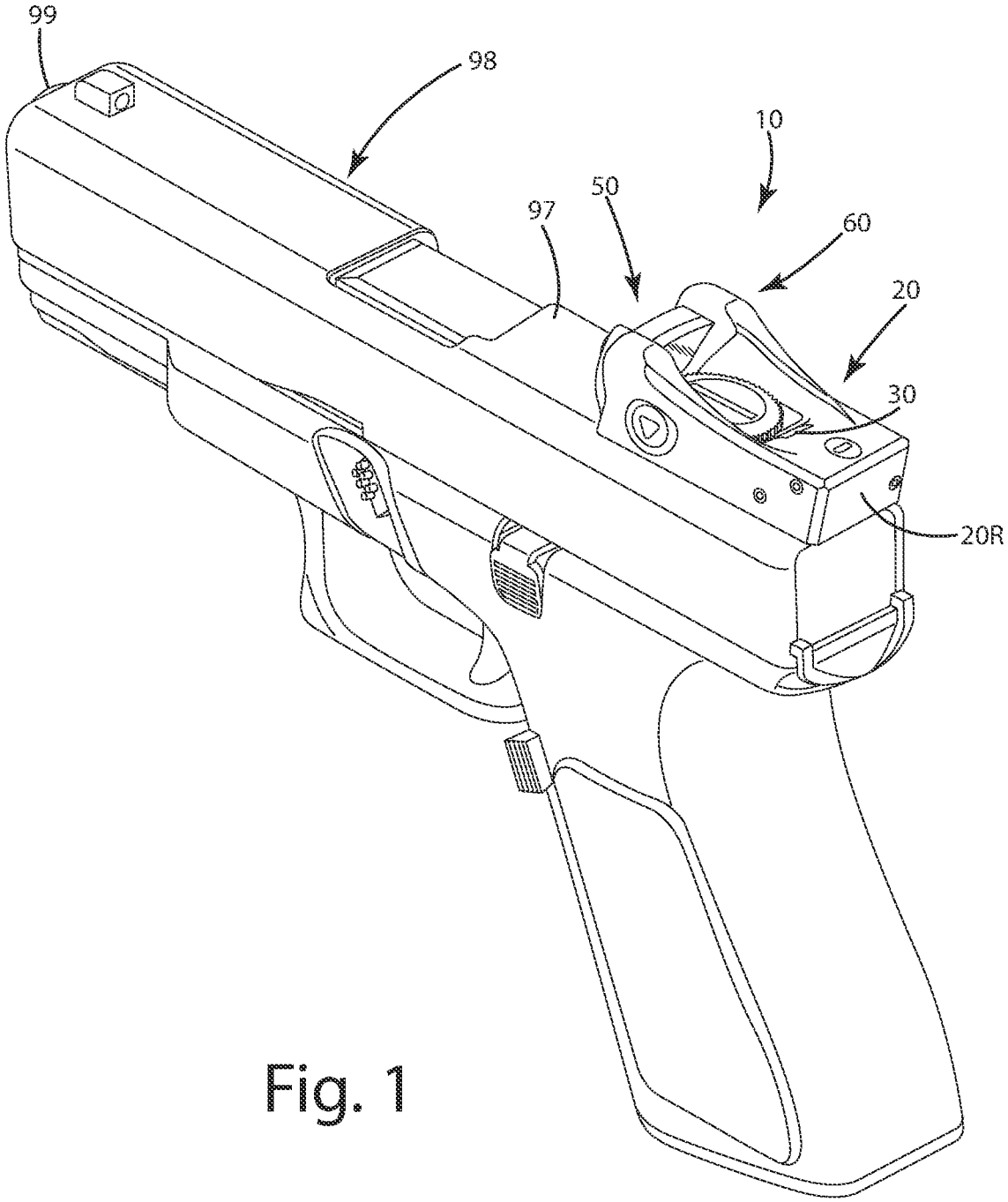
FIG. 1 is a rear perspective view of the aiming device of a current embodiment mounted on a firearm.

Returning to the sight 10 mounted on the firearm in FIG. 1, the sight can be mounted atop a slide 97 of the pistol 98, generally to the rear of the slide, over a grip of the pistol. The sight 10 can be mounted in the same location where a mechanical rear sight was once located.

The sight 10 can include a body 20 that functions as a housing for electronics, an illumination device 30 and a power source 39, such as a battery, capacitor or other electricity storing or generating element. The body 20 includes an upwardly extending protective frame 40 joined with the body and optionally forming a portion thereof. Although shown as an open top protective frame, that frame can be in form of a closed top frame. An optical element 50, optionally in the form of a non-magnifying lens can be mounted in a generally upright position in the protective frame, thereby providing a viewing window for a target T in a field of view. Light, illumination and/or a holographic image is emitted from an illumination device 30, which in some cases can be include one or more miniature light emitting diodes (LED) 31 positioned at a focal point rearward of optical element 50 and within the body 20.

The illumination device 30 can be operable to selectively display or reflect one or more dots as explained below on or from the optical element that are selectively visible to a user within a field of view of the user, depending on whether the aiming device is in an aligned mode or a misaligned mode. In this regard, the light from the illumination device 30 optionally can be reflected rearward toward the user's eye by a dichroic reflection layer or coating of the optical element, which can be a lens 50, as collimated light, so that the user perceives the reflected light as the below described dots as the dots are superimposed on the field of view at infinite distance and in a projection region or plane PP.

Figure 4:
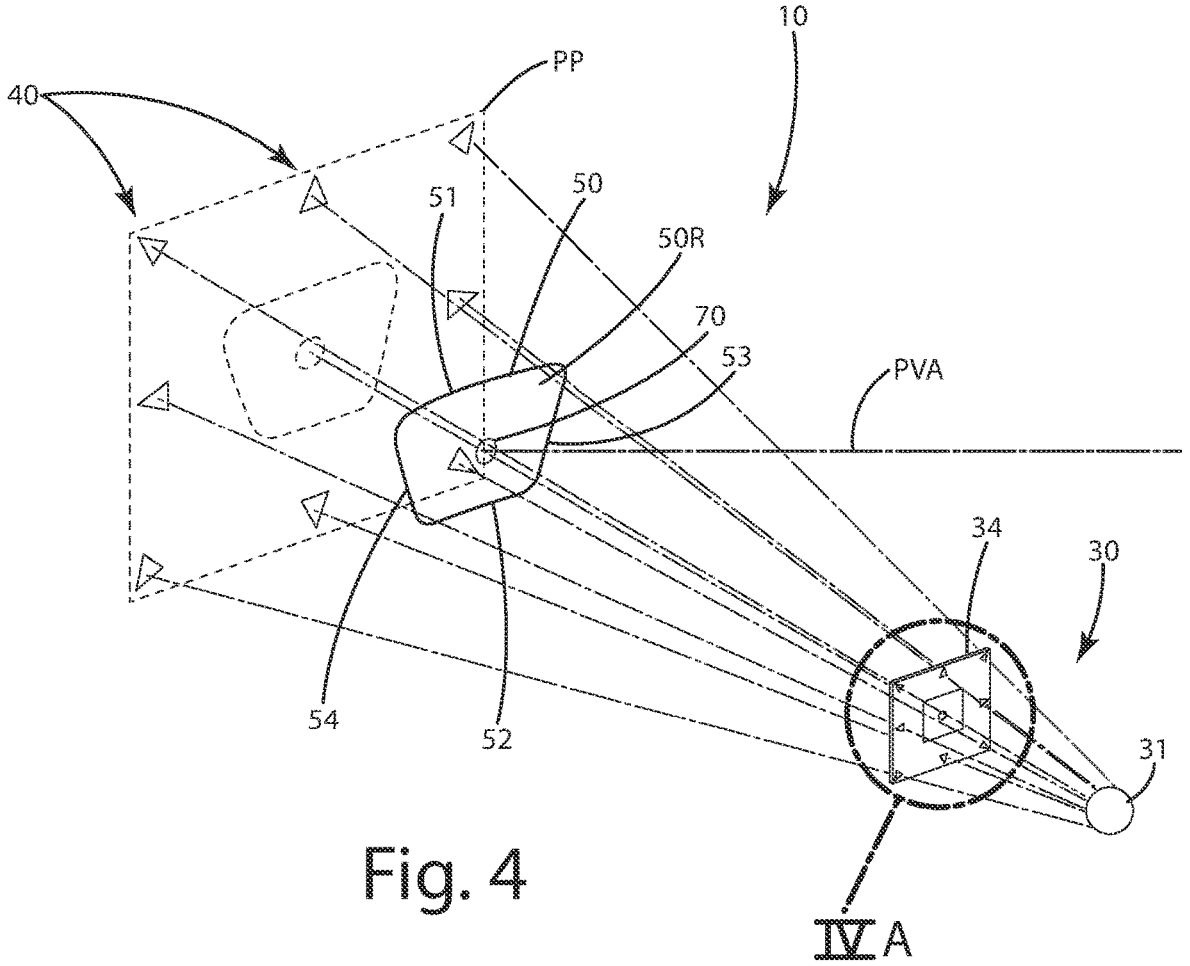
FIG. 4 is a perspective view of an illumination device projecting the primary dot and multiple secondary alignment dots in a projection region, with the primary dot displayed on an optical element of the aiming device, and the aiming device being in an aligned mode.
Figure 4A:
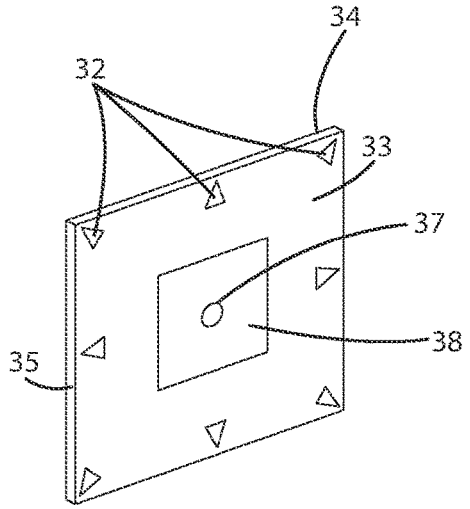
FIG. 4A is a close up view of a multicolored illumination device lens that transmits light of a first wavelength to project the primary dot and transmits light of a second wavelength to project the secondary alignment dots.

The illumination device 30 as mentioned above can include a miniature LED 31. The illumination device 30 also can include or otherwise be configured to project dots having different shapes and/or colors that can be viewed and/or visible within a field of view FOV of a user. As described below, the dots can include a primary dot 70 and one or more secondary alignment dots 40 as shown in FIG. 4. To produce or project the primary dot and secondary alignment dots, the illumination device can be outfitted with an LED lens 34. This LED lens 34 can include multiple apertures defined in a plate 35. These apertures can include a primary dot aperture 37 and one or more secondary alignment dot apertures 32. The primary dot aperture 37 can be disposed centrally in the geometric center of the plate 35. The secondary alignment dot apertures 32 can be aligned near the edges of the plate. As shown, the plate can be square, with some of the secondary alignment dot apertures 32 disposed at the corners of the plate, and others disposed about midway between the respective corners of the plate. Of course, the light apertures can be configured in different patterns and shapes so that the dots and dot pattern projected through the lens or plate 34 is of different configurations that what is shown. Further, more or fewer secondary alignment dots can be projected by the illumination device by altering the respective apertures. When light passes through the lens or the plate, via the primary dot aperture, and secondary alignment dot apertures, the light transmits toward and/or to a projection region PP, which optionally can be a plane that intersects the projected light.

The lens or plate can again be constructed to project dots of different colors or wavelengths. For example, the lens can be separated into two different lens areas 33 and 35. These lens areas can be configured to transmit light of different wavelengths. For example, the lens area 38 can transmit light of a first wavelength, while the second lens area 33 can transmit light of a second wavelength, which is different from the first wavelength. Thus, the illumination device projects the light of the first and second wavelengths to the optical element 50 which in turn reflects that light and displays those wavelengths to a user within a field of view of the user in the form of the respective primary dot and secondary alignment dots. Of course, in other applications, other various lenses can be utilized to transmit light of a variety of different wavelengths to produce a variety of different colored dots.

As used herein, the term dot can refer to any dot, mark, image, indicia, direction indicator, pointer, arrow element, illumination device, illumination element light and/or reticle pattern reflected or otherwise displayed by or on the aiming device. The term dot also can refer to holographic images that are used to sight the aiming device on a target, whether or not disposed or displayed on the optical element, or in front of it or behind it. In the embodiment illustrated, the primary dot 70 can be in the form of a circular dot, but can alternatively can be in the form of a cross, a chevron, a triangle or any other reticle shape. Each of the secondary alignment dots as illustrated can be in the form of arrow elements, that is, elements, images, indicia, markings, lights or illumination elements that form a point or a triangular element, or other shapes depending on the application. Alternatively, the secondary alignment dots can be in the form of circular, round, polygonal shapes or lines, depending on the application.

Figure 3:
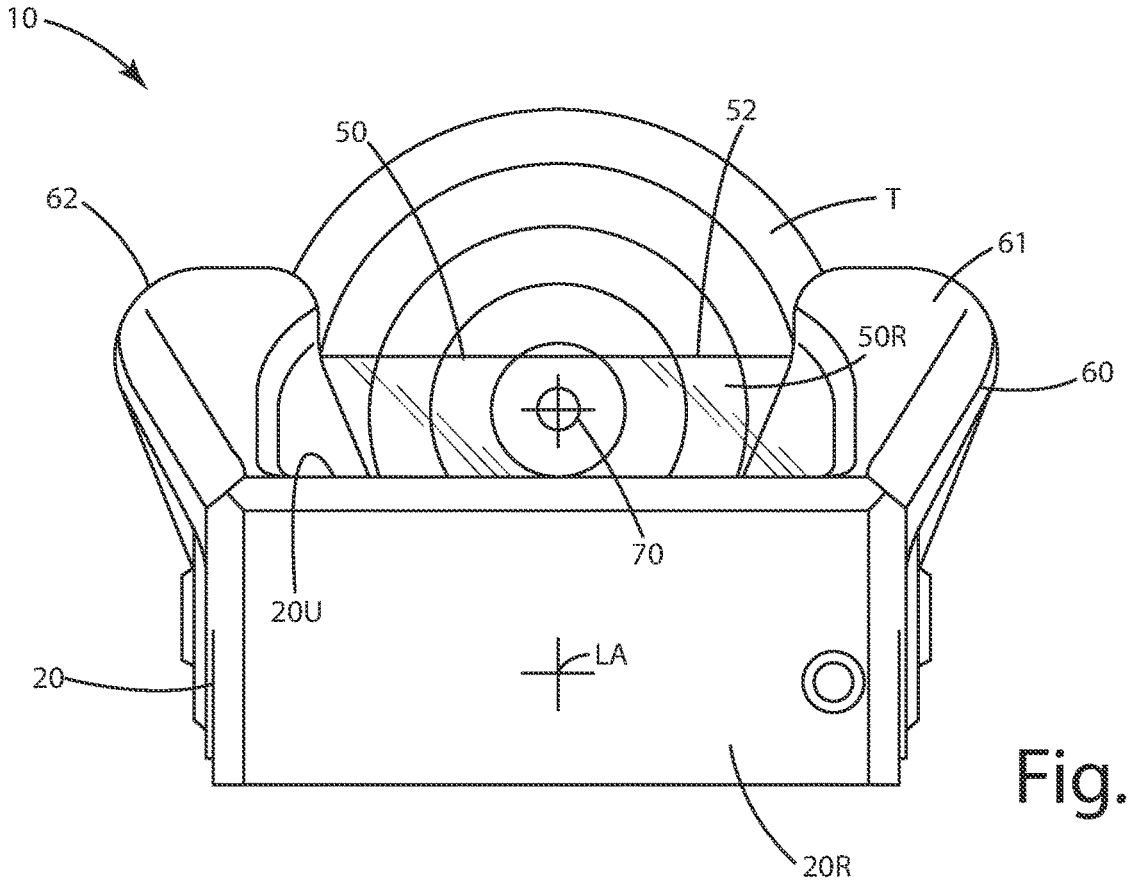
FIG. 3 is a rear view of the aiming device from a user's point of view while acquiring a target and aligning a primary dot with the target.

Optionally, each of the secondary alignment dots, when in the form of the illustrated arrow elements can point radially away from the primary dot. In other applications, they can simply point generally away from the primary dot. The tips of the arrow elements can point in a direction that corresponds to a direction in which a user should move a muzzle 99 of the firearm to gain a better view of the primary dot 70 reflected from the optical element 50, and thus use that primary dot to align the aiming device and thus the weapon with a target T as shown in FIG. 3.

Returning to the concept of different wavelengths optionally used for the different dots, in one embodiment, the primary dot 70 can be of a first color, for example red, while the secondary alignment dots 40 can be a second color, for example green. With these different colors, a user typically will not confuse the primary dot 70, which is used to align with a target T, with the secondary alignment dots 40, which in contrast are used to assist the user in acquiring an initial or better view of the primary dot in the user's field of view FOV. Generally, the primary dot 70 can be reflected from the optical element 50 and displayed within a first wavelength range. The one or more secondary alignment dots 40 can be reflected from the optical element 50 and displayed within a second wavelength range, different from the first wavelength range. Optional wavelength ranges for the first wavelength range and the second wavelength range can include the following wavelength ranges associated with the noted colors of the spectrum: 380 nm to 450 nm (violet); 450 nm to 485 nm (blue); 485 nm to 500 nm (cyan); 500 nm to 565 nm (green); 565 nm to 590 nm (yellow); 590 nm to 625 nm (orange); or 625 nm to 740 nm (red).

The illumination device 30 as mentioned above can include the miniature LED 31 which can be powered by a power source 39. The power source can be a battery, a capacitor or some other type of energy for electricity generating device. Optionally, the illumination device 30 can be powerless, without a dedicated onboard power source, such that the respective dots are generated by transmitting ambient light from light pipes, fiber optics and/or other reflective or transmissive elements that convert ambient or environmental light to project such dots. As illustrated, however, the power source 39 can be disposed in a battery compartment 39C defined by the body 20. The power source 39 can be a button cell battery that powers electronics 38 that drive the illumination device 30. The battery can be accessed via a threaded lid that covers a threaded opening to the compartment located in body 20 between optical element 50 and the illumination device 30. The lid can be recessed below the illumination device 30 to provide a clear optical path for illumination generated by it to reach lens 50. A small slot or notch can be provided in a top of lid to assist in grasping it with a user's fingernail for toolless opening, or with the rim of a cartridge, a coin or tool. When closed, the lid can be sealed to body 20 via an O-ring (not shown) that is compressed between lid and a tapered surface bordering the opening to the compartment 39C.

Figure 2:
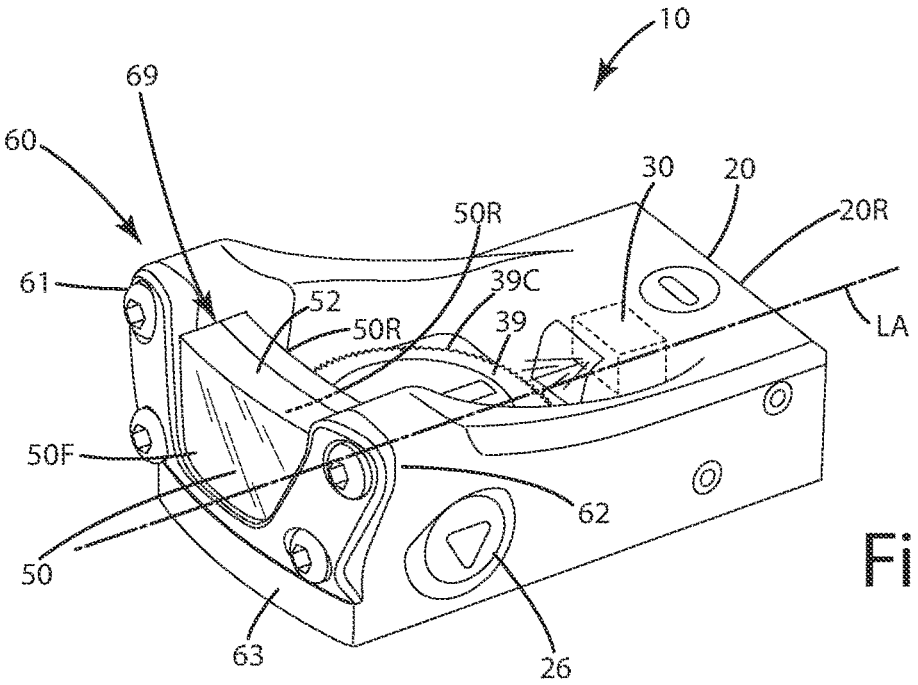
FIG. 2 is a front perspective view of the aiming device.

With reference to FIG. 2, the body 20 can include a selector button 26 formed of an elastomeric or flexible plastic material that is manually depressible to control a setting of sight 10. The selector button 26 may allow a user to control of a setting of the sight, such as an illumination mode, dot configurations, dot shapes, dot colors, illumination brightness, reticle pattern, other attribute of the dots, or an ON/OFF function of the sight 10. Generally the selector button can be in electrical communication with the electronics of the sight, which can include a circuit, a processor or other elements that are further in communication with the illumination device 30 and/or the power source 39. Again, the selector 26 can provide signal input to the electronics and enables a user to cycle through various illumination settings of sight 10. Optionally, the selector button 26 can be depressed to toggle between an automatic mode and one or more manual modes for an illumination or projection of the primary dot 70 and/or the secondary alignment dots 40. setting of aiming mark 59. In an automatic mode, a photo sensor or other light sensor (not shown) of sight 10 can measure ambient light and a brightness control circuit may automatically determine and set an appropriate illumination intensity of dots 40, 70 based on the measured ambient light. In a manual mode, the user can cycle through various illumination settings by manually depressing selector button until a suitable light intensity level is obtained. Further optionally, a user can depress the selector button to cycle through several settings in sequence, including: ON, high, medium or low intensity, and OFF.

With reference to FIGS. 1-2, the aiming device 10 includes the optical element 50 noted above. This optical element 50 can be joined with the body 20 via a protective frame 60, which can form part of the body. The protective frame 60 can be integrally formed with the body or a housing of the body. In many cases, the protective frame can be aesthetically integrated into and can form an extension of the body and its components. The frame itself and/or the body can be constructed from a variety of materials, such as polymers, composites, metals and combinations thereof. Optionally, the optical element, frame and body can form an aiming device such as that disclosed in U.S. Patent Application Publication 2019/0360777 to Grace, et al first filed on May 23, 2018, which is hereby incorporated by reference in its entirety, or U.S. provisional patent application 62/806,214 to Grace et al filed Feb. 15, 2019, which is hereby incorporated by reference in its entirety.

As shown in FIG. 2, the protective frame 60 can include a base 63, a first upright arm 61 and a second upright arm 62. The base, first arm and second arm can cooperatively form a viewing recess 69 within which the optical element 50 is at least partially disposed. The base 63 can extend laterally from a left side to a right side of the sight 10, generally crossing the longitudinal axis LA of the base and the aiming device in general. This longitudinal axis LA can generally bisect the sight 10 into corresponding left and right sides.

As shown in FIGS. 2-3, the optical element 50 is disposed in the viewing opening 69 defined in the frame. Faces of the optical element include the front facing surface area 50F and the rear facing surface area 50R. The rear surface 50R is faced toward a user when using the sight, while the front surface 50F faces away from the user using the sight. The rear facing surface area can be concave or convex or flat, but as shown is concave rearward. The optical element can be constructed from glass, polymer, polycarbonate, crystal, or other light transmissive or transparent materials. Some non-limiting examples of lenses can include TRIVEX lenses, commercially available from PPG Industries of Pittsburgh, Pa., as well as a nanolayered gradient refractive index (GRIN) lenses, commercially available from Peak Nano of Coppell, Tex. Optionally, lens material can be doped with or otherwise include thermal chromic, photochromic or other light adaptive materials. In this manner, the optical element can function like photochromic lenses, thermochromic lenses or other light adaptive lenses. When including a photochromic material or compound, the optical element, when activated by ultraviolet rays from the sun, can darken.

When ultraviolet rays are not present, the optical element can be less darkened or more clear.

The optical element 50 rearward and forward facing surface areas as illustrated can have different radii and optional reflective coatings on a shallower rear surface. Optionally, the optical element 50 can be in the form of a Mangin mirror, having a negative meniscus lens with the reflective surface on the rear side of the glass forming a curved mirror that reflects light without spherical aberration. Of course, other types of optical elements, suitable for reflex type sights to assist in displaying, superimposing or otherwise imaging light or a holographic image on the optical element or in the sight can be utilized.

As mentioned above, the optical element 50 can include multiple edges. For example, optical element 50 can include an upper edge 51, side edges 53 and 54 and a lower edge 52. The upper edge 51 as mentioned above optionally is not concealed by any part of the protective frame or the sight directly above that upper edge, so that upper edge is exposed to the environment and unconcealed by any part of the protective frame directly above the upper edge. In some applications, this upper edge can be covered and concealed. The optical element lower edge 52 can be disposed adjacent the base 63. The first edge 54 can be disposed adjacent the first of upright arm and the second edge can be disposed adjacent the second upright arm 62.

As mentioned above and shown in FIGS. 3-6, the aiming device 10 can be operable in an aligned mode and a misaligned mode. Generally, in the aligned mode, the primary dot 70 is visible to a user within a field of view FOV of the user U, but one or more or all the secondary alignment dots around the primary dot are not visible to the user, within the field of view of the user. The primary dot 70 in the aligned mode can be reflected from the optical element 50 toward a user U. The primary dot 70 can be in a field of view FOV of a user, who views the aiming device from the rear 20R of the body 20, that is, with the user looking toward the rear of the body. When the primary dot 70 is viewable on the optical element, the optical element has selectively displayed thereon the primary dot 70 that is visible to the user U. The dot 70 itself is visible to the user within the field of view FOV of the user U. The user can thus use the primary dot 70 and align it with a target T to engage the target with the weapon to which the aiming device is attached.

Figure 5:
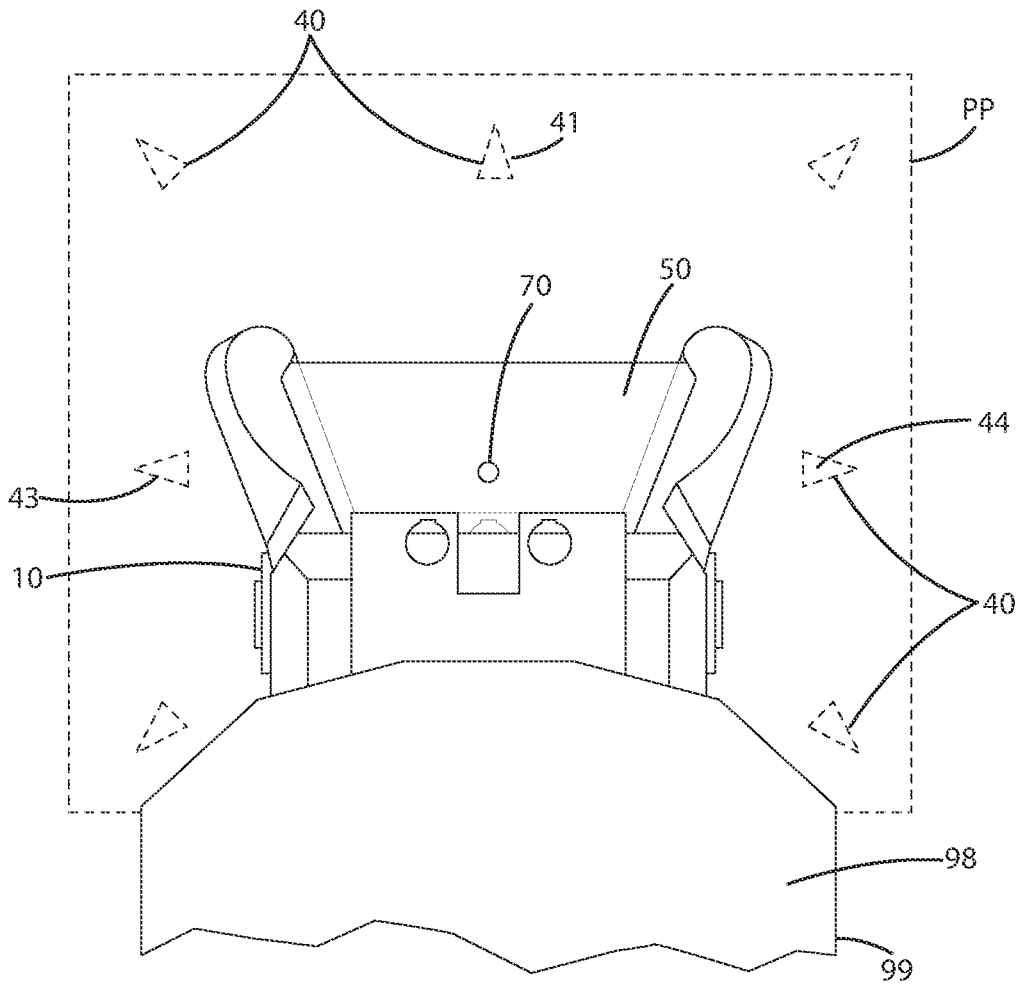
FIG. 5 is a rear view of the aiming device in an aligned mode, with the primary dot visible to a user in a field of view of the user.
Figure 6:
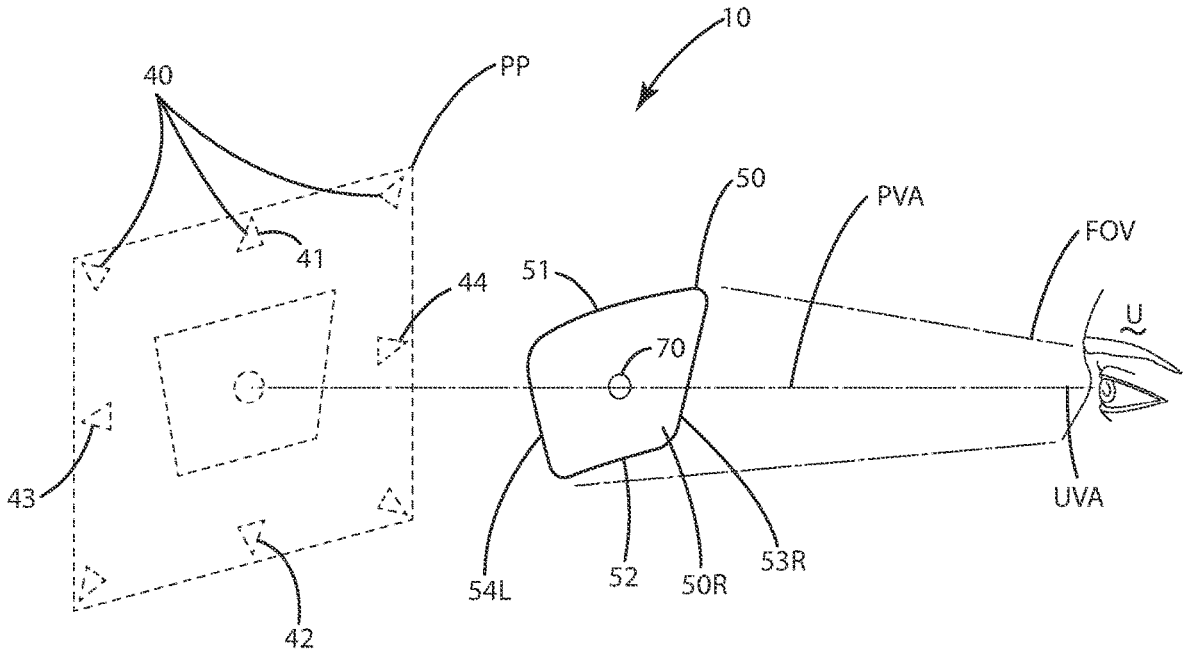
FIG. 6 is a side perspective view of the aiming device in the aligned mode of FIG. 5, with the primary dot visible to a user in the field of view, but the secondary alignment dots not visible to the user within the field of view.

With reference to FIGS. 4-5, the aiming device components will be described in more detail when the aiming device 10 is in the aligned mode. As mentioned above, the illumination device 30 projects a primary dot 70 and multiple secondary alignment dots 40 disposed generally around the primary dot 70. The transmitted or projected light that produces these dots optionally can go on to infinity, but for the sake of simplicity are described in connection with projection region PP corresponding to a plane that intersects the light rays corresponding to the respective dots. This projection region PP is shown in FIGS. 4-6. There, the projection region PP optionally can be disposed farther away from the illumination device 30 than the optical element 50. The projection region PP also can be disposed farther away from a user U than the optical element 50. Optionally, even though shown as distal from the optical element, the projection plane PP can be parallel and/or lay in one or more planes of the optical element.

The illumination device 30 as shown projects light to produce the primary dot and the secondary alignment dots in the projection region by light passing through the lens 34, in particular, the primary dot aperture 37 and the secondary alignment dot apertures 32. The light is transmitted through these apertures and again projects in or on the projection region PP. In the aligned mode, the light corresponding to the primary dot 70 intersects the optical element 50 and is reflected by that lens, along a primary viewing axis PVA shown in FIGS. 4 and 6. This primary viewing axis PVA projects rearward from the optical element 50 and its rearward facing surface 50R so that the primary dot is visible to a user in the user's field of view. In the aligned mode, this primary viewing axis is generally aligned with a viewing axis UVA of the user in the field of view of the user. Accordingly, the primary dot 70 is reflected back toward the user so that the primary dot is visible to the user in the user's field of view FOV.

In this aligned mode, shown in FIG. 6, however, all the secondary alignment dots 40, which are located distally outward from the primary alignment dot 70, are not visible to the user U in the user's field of view FOV. This is because the light corresponding to the secondary alignment dots 40 is not reflected back toward the user, in the user's particular field of view FOV in the aligned mode. While the light corresponding to the secondary alignment dots 40 is still projected in the exact same paths between the illumination device 30 and the optical element 50, the user's perspective obscures those secondary alignment dots 40 from view. That is, the secondary alignment dots 40 are not exposed or perceived on the optical element or by the user in general. This is illustrated in FIGS. 5-6 via the secondary alignment dots 40 being shown in broken lines. Indeed, wherever the secondary alignment dots 40 or the primary alignment dot 70 are illustrated in the figures in broken lines, this means that those elements are not visible to the user, even though they are being projected, for example in the projection region PP. It is also noted that a user would not be able to perceive directly the entire projection region PP, from the perspective in FIGS. 5, 7 and 9, which is why is it is shown in broken lines there and elsewhere in the relevant figures.

FIG. 6 also illustrates the user's field of view FOV in relation to the projection region PP with all the respective dots in that region. There, the user views the optical element 50 along the user's viewing axis UVA in the field of view FOV. Because the optical element is properly aligned with the user's eye, the user perceives only the primary dot 70. Projecting the optical element 50 onto the projected region PP is shown via the outline 50'. The user, from the perspective shown in FIG. 6, thus can only see the elements in the projected region PP within the outline 50'. Because the field of view FOV is generally properly aligned relative to the aiming device, the user U can view the primary dot 70, which is inside the outline 50', but everything outside the outline 50' is not visible to the user. Thus, none of the secondary alignment dots are visible to the user and are out of the field of view of the user in the aligned mode. Of course, in some applications, portions of the secondary alignment dots might be slightly visible around the edges of the optical element in the aligned mode. This can vary from application to application.

As also shown in FIG. 6, the secondary alignment dots 40 are projected beyond the edges of the optical element 50 and further are projected beyond the corresponding edges in the outline 50' projected on the projected region PP. For example, the optical element includes the upper edge 51, the lower edge 52, the left edge 54 and the right edge 53. The secondary alignment dots 40 can include an upper alignment dot 41, a lower alignment dot 42, a left alignment dot 43 and a right alignment dot 44. All of these respective alignment dots can be disposed beyond the respective edges. Optionally, the upper alignment dot 41 can be projected beyond the upper edge 51 and the left alignment dot 43 can be projected beyond the left edge 54; the lower alignment dot 42 can be projected beyond the lower edge 52, and the right alignment dot 44 can be projected beyond the right edge 53, and so on, when the aiming device is in the aligned mode shown in FIG. 6 or something close to that configuration and orientation of the user's field of view FOV relative to the optical element.

With further reference to FIG. 6, the relationship between the size and shape of the optical element 50 relative to the projection region PP is illustrated. There, the projection region PP is larger in area than the rearward facing surface area 50R of the optical element 50. In the aligned mode, with this disparity in size and area, the secondary alignment dots 40 are projected beyond, outside of, or generally distal and away from that rearward facing surface area, as perceived from the perspective of the user U viewing the optical element within the field of view in the aligned mode. In general, in this aligned mode, the alignment dots are simply outside the user's field of view FOV and cannot be perceived as being superimposed or displayed on the optical element as shown in FIG. 5 as well.

It is to be noted however, that even though the user cannot perceive the secondary alignment dots 40, these dots are still being simultaneously projected by the illumination device with the primary dot 70 in the projection region that overlaps the optical element 50. Again, because the projection region PP is larger than the optical element from the perspective of the user in the illustrated field of view, the portion of the projection region including the secondary alignment dots 40 lay, unperceivably to a user, beyond the edges of the optical element 50. In addition, the secondary alignment dots 40 lay beyond the corresponding edges of the outline 50' of the optical element in the projection region PP. Thus, the secondary alignment dots are not visible to the user within the field of view of the user from that particular perspective in the aligned mode.

As noted above, the aiming device 10 is operable in the aligned mode, as well as a misaligned mode. In the misaligned mode, the aiming device can provide visual feedback to the user via one or more of the secondary alignment dots to assist the user in reorienting, moving or angling the aiming device to attain a better view of the primary dot 70 within the user's field of view FOV. In general, at least one of the secondary alignment dots 40 is visible to the user within the field of view of the user in the misaligned mode. The primary dot typically is not visible when the field of view of the user in this misaligned mode or is barely visible. Some exemplary misaligned modes of the device are illustrated in FIGS. 7-10.

Figure 7:
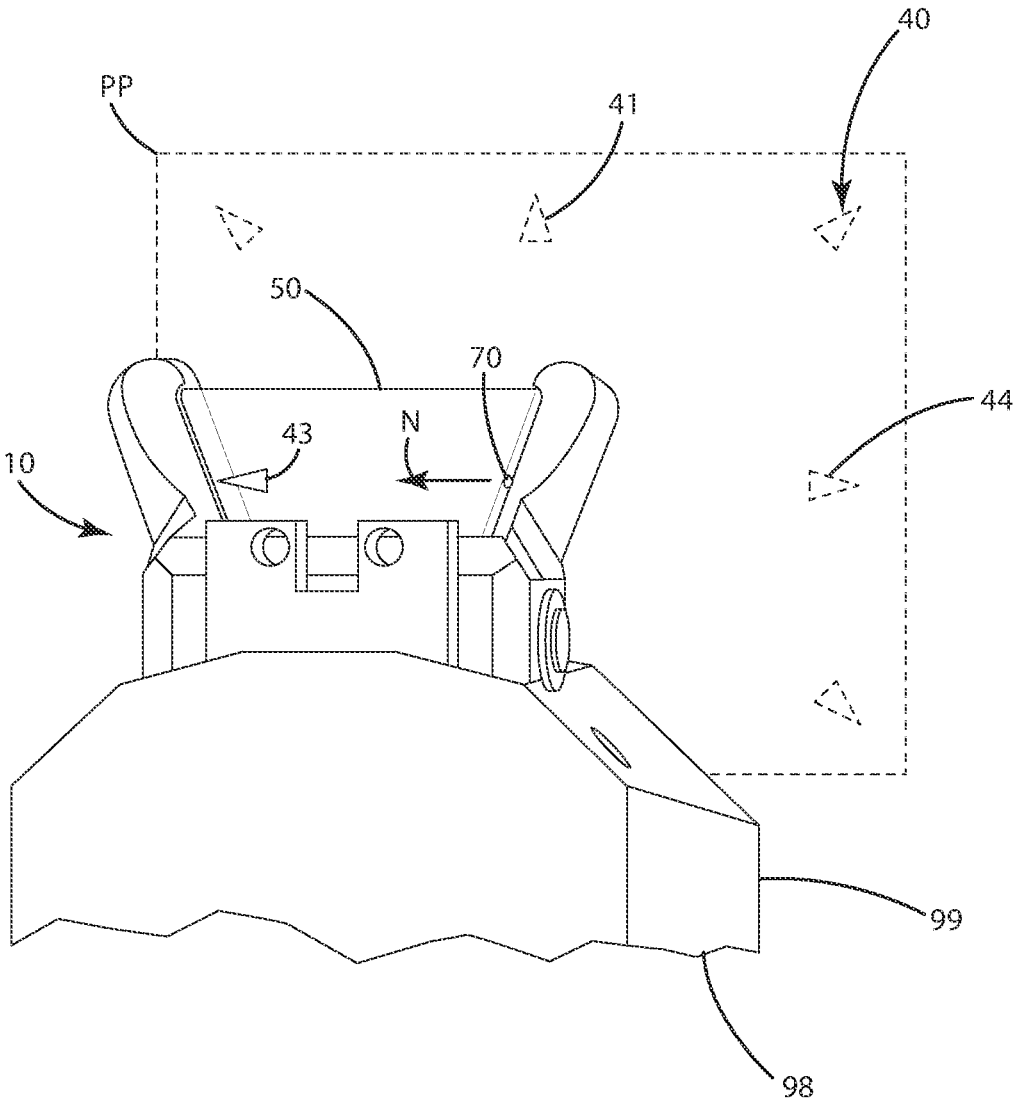
FIG. 7 is a rear view of the aiming device in an exemplary first misaligned mode, with the primary dot barely visible to a user in a field of view, and a secondary alignment dot providing instruction to the user to move the aiming device and gain or improve visibility in the user's field of view of the primary dot.
Figure 8:
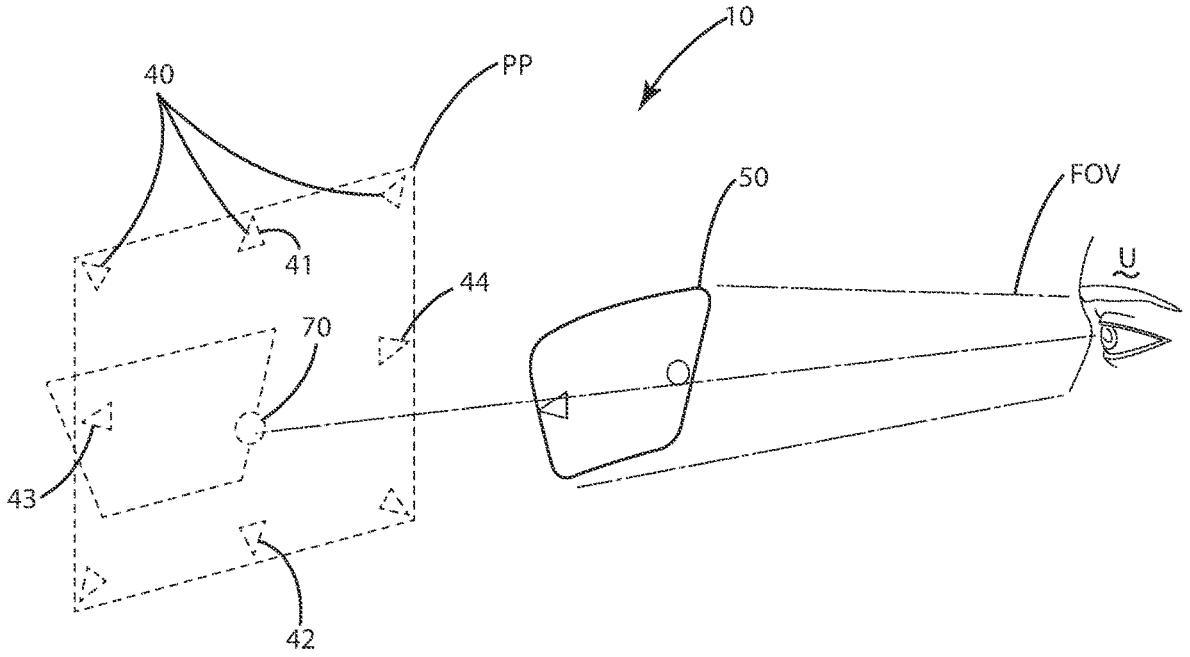
FIG. 8 is a side perspective view of the aiming device in the first misaligned mode of FIG. 7.

With reference to FIGS. 7-8, a first misaligned mode is illustrated. There, a user U has misaligned the aiming device 10. This can occur by angling the muzzle 99 of the firearm 98 too far to the right such that the primary dot 70 is obscured and/or not displayed on the optical element 50. The aiming device 10 immediately provides instruction and visual feedback via the exposed secondary alignment dot 43 displayed on the optical element 50. By viewing this secondary alignment dot 43 the user can readily perceive that the muzzle 99 must be moved in the direction of the arrow element 43 displayed on the optical element 50. When the user so moves the aiming device with the firearm, the primary dot 70 moves in direction N and in the user's field of view FOV so that the primary dot can be readily centered on the optical element 50 and aligned with a target T. Generally, in this misaligned mode, the visible secondary alignment dot 43 provides instruction to the user to realign the aiming device relative to the field of view of the user so that the aiming device transitions to the aligned mode, such that the user again can attain the view shown in FIG. 5, with the primary dot 70 in a helpful location within the user's field of view to aim with the aiming device.

In the misaligned mode as illustrated in FIG. 7, optionally only certain ones of the secondary alignment dots 40 are visible to the user. For example, the left alignment dot 43 is visible to the user in the field of view FOV, but the right alignment dot 44, as well as the upper 41 and lower 42 alignment dots remain not visible to the user. A portion of the primary dot 70 may also be visible to the user. None of the dots 40 shown in broken lines are visible or perceivable by user. This or any other misaligned mode can be analogized to a person viewing a large picture through a tiny window, standing a distance from the tiny window. Because of the tiny window, the user can only see a small portion of the large picture. If the user wants to view a particular region of the picture, they must reorient themselves relative to the window. Here however, the window is the optical element 50 and a portion of the picture is displayed through that optical element. To view different parts of the picture, for example, to better view the primary dot, the user must move the aiming device rather than their head to acquire a different view.

Figure 9:
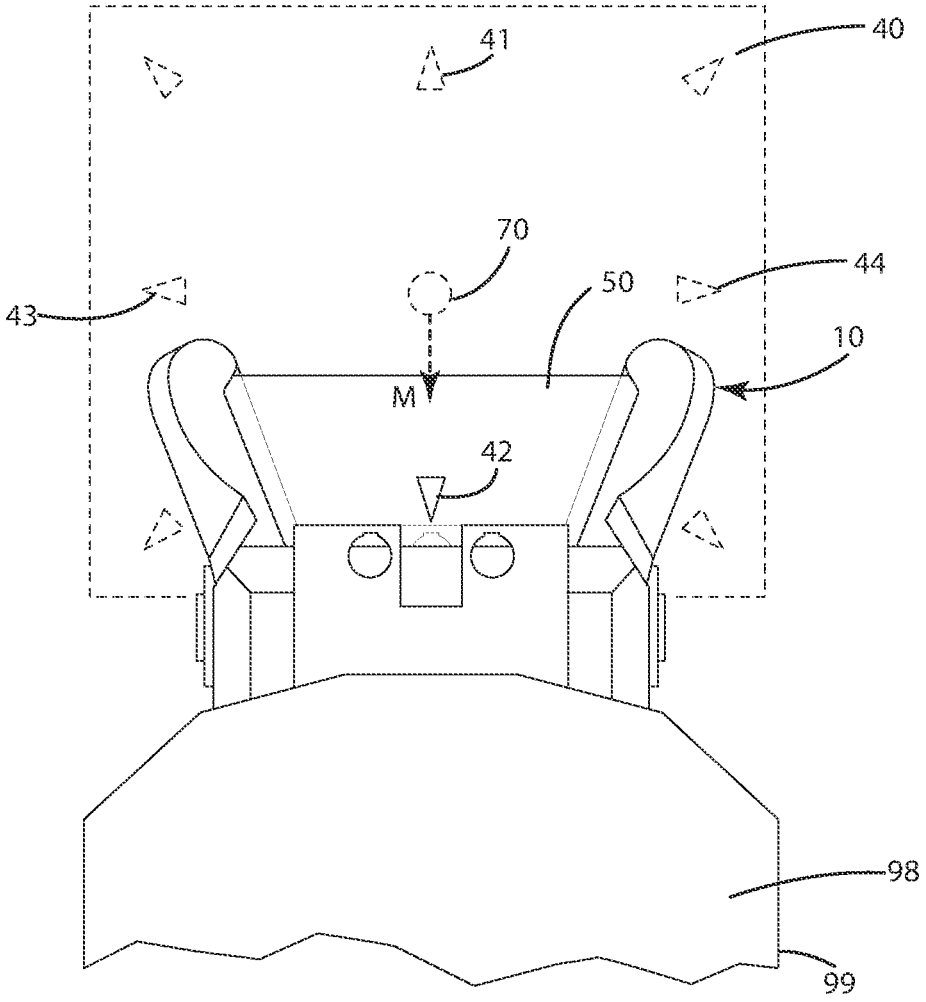
FIG. 9 is a rear view of the aiming device in an exemplary second misaligned mode, with the primary dot not visible to a user in a field of view, and a secondary alignment dot providing instruction to the user to move the aiming device and gain visibility in the user's field of view of the primary dot.
Figure 10:
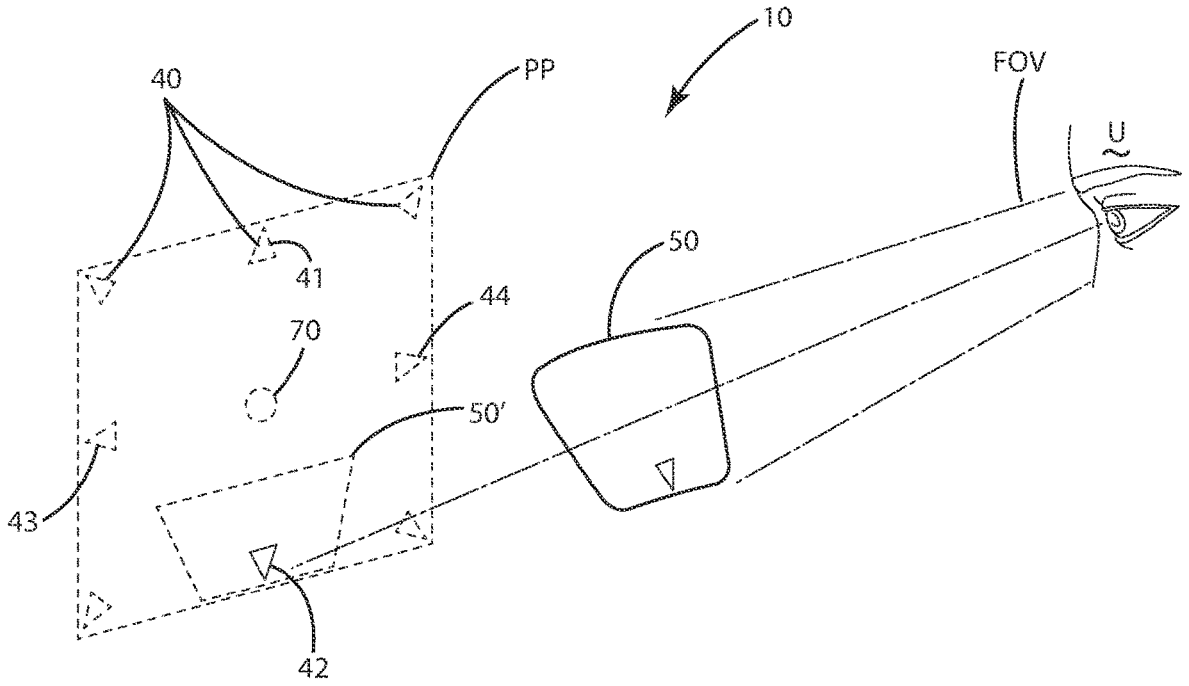
FIG. 10 is a side perspective view of the aiming device in the second misaligned mode of FIG. 9.

A second exemplary misaligned mode is shown in FIGS. 9-10. There, the user U has misaligned the aiming device 10. This can occur by angling the muzzle 99 of the firearm 98 too far upward such that the primary dot 70 is obscured and/or not displayed on the optical element 50. The aiming device 10 provides instruction and visual feedback via the exposed secondary alignment dot 42 on the optical element 50. By viewing this secondary alignment 43 the user can readily perceive that the muzzle 99 must be moved downward in the direction of the arrow element 42 displayed on the optical element 50. When the user so moves the aiming device with the firearm, the primary dot 70 moves in direction M and back into the user's field of view FOV so that the primary dot can be readily centered on the optical element 50 and aligned with a target. Again, in the illustrated misaligned mode, the visible secondary alignment dot 42 provides instruction to the user to realign the aiming device relative to the field of view of the user so that the aiming device transitions to the aligned mode, such that the user again can attain the view shown in FIG. 5, with the primary dot 70 in a helpful location within the user's field of view to aim with the aiming device.

On a high level, the aiming device 10 herein can be used in a method of operation. In general, the method can include: projecting a primary dot and at least one secondary alignment dot distal from the primary dot simultaneously in a projection region that overlaps an optical element having at least one edge, the projection region extending beyond the edge of the optical element; and making the primary dot visible to a user within a field of view of the user, but the at least one secondary alignment dot not visible to the user within the field of view of the user, when the aiming device is in an aligned mode.

Optionally, the method can include making the at least one secondary alignment dot visible to the user within the field of view of the user, but the primary dot not visible within the field of view of the user, when the aiming device is in a misaligned mode, so as to provide instruction, via the visible at least one secondary alignment dot, to the user to realign the aiming device relative to the field of view of the user. Further optionally, the method can include continuing to project the primary dot, and the at least one secondary alignment dot, which includes a upper secondary alignment dot, a lower secondary alignment dot, a left secondary alignment dot and a right secondary alignment dot, simultaneously in the projection region in both the aligned mode and the misaligned mode. Each of the upper secondary alignment dot, the lower secondary alignment dot, the left secondary alignment dot and the right secondary alignment dot are located beyond the at least one edge of the optical element and out of the field of view of the user such that they are not displayed on or reflected to the user, or perceived by the user, in the aligned mode.

As an example of the method, with reference to FIG. 5, an aligned mode of the method is illustrated from a user's perspective. There, a user can view in their field of view FOV the optical element 50 which is included in the aiming device 10. In this mode, the muzzle 99 of the firearm 98 is properly aligned straight forward, such that the aiming device 10 is also aligned within the field of view FOV. As a result, the primary dot 70 is displayed properly on the optical element 50. As the primary dot 50 is displayed, however, the secondary alignment dots 40 are projected to the projection region, which may or may not lay within the same plane or planes as the optical element 50. Due to these alignment dots being projected beyond the edges of the optical element 50, the user cannot see those dots in the optical element 50. That is to say, these alignment dots are not displayed on the optical element or otherwise visible to the user of the aiming device 10, even though these alignment dots are simultaneously projected on the projection region PP.

As another example of the method, with reference to FIG. 7, a misaligned mode of the method is illustrated from a user's perspective. In this mode, the muzzle 99 of the firearm is not pointed straightforward and instead is angled to the right within the user's field of view. As a result, the primary dot 70 is barely or not displayed at all on the optical element 50 to the user. In this orientation, however, the user now views a different portion of the projected region PP as displayed on the optical element 50. Because the user's perspective has changed relative to the projection region PP, as well as the associated reflection of the lens 34 and associated apertures 37 and 32, one or more of the secondary alignment dots, for example the left secondary alignment dot 43 is displayed on the optical element 50 such that the user can view that dot 43. This dot 43 provides visual instruction and/or feedback to the user so the user can realign the aiming device relative to their field of view. More particularly, the dot 43 points to the left, which conveys to the user to move the muzzle 99 to the left to realign the aiming device and thus the optical element. When the user does so realign, move or otherwise reorient the aiming device in the direction indicated, the primary dot moves in direction and to re-center and be displayed in the optical element. As this occurs, the alignment dot 43 moves out of the field of view of the user to the location indicated the aligned mode shown in FIG. 5.

Depending on the orientation of the muzzle 99 relative to the rear of the weapon 98, a variety of different ones of the secondary alignment dots can be displayed on the optical element. The display of these different dots can again inform the user with visual feedback via those dots as to the direction to move the aiming device and gain a better view of the primary dot 70.

Figure 11:
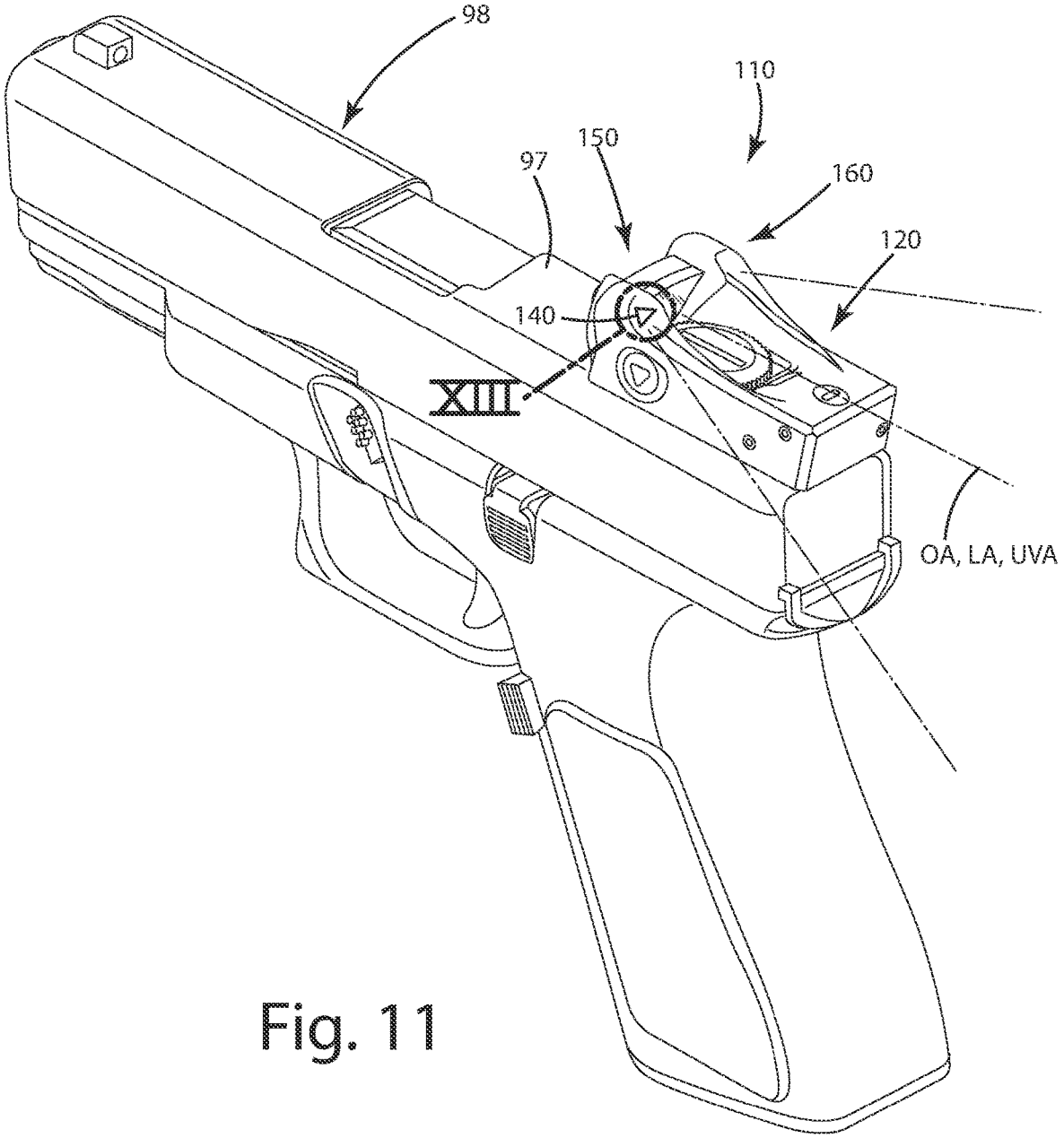
FIG. 11 is a rear perspective view of the aiming device of a first alternative embodiment mounted on a firearm.
Figure 12:
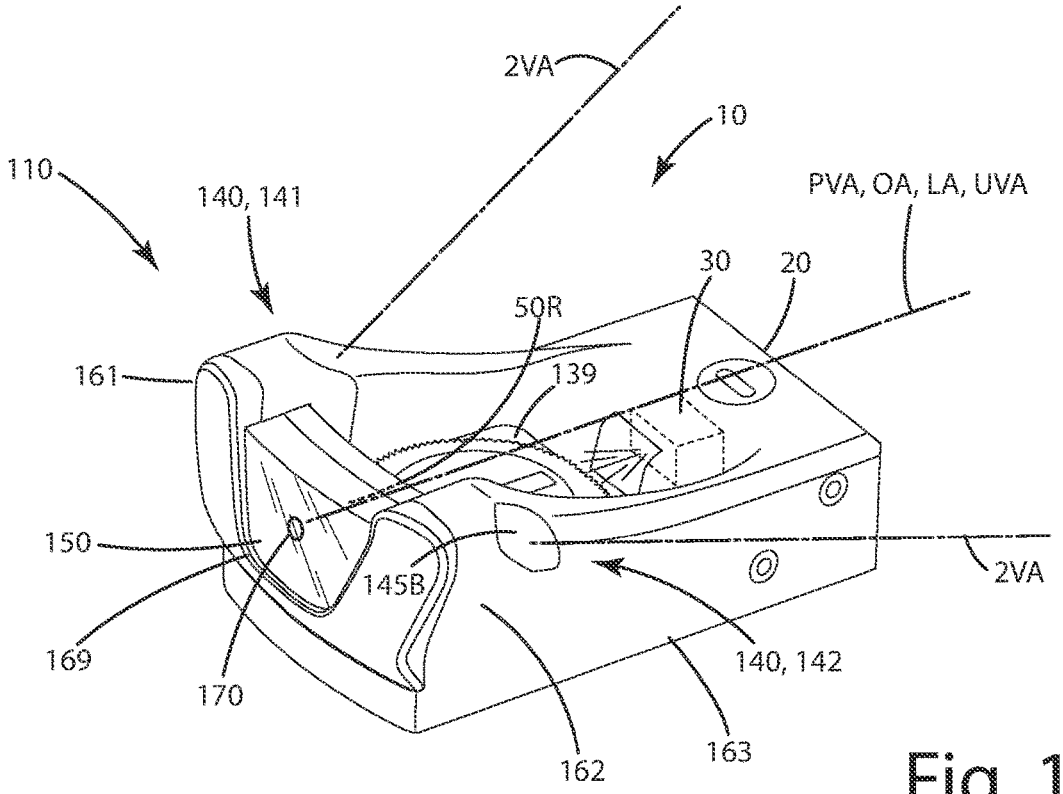
FIG. 12 is a front perspective view of the aiming device of the first alternative embodiment.

A first alternative embodiment of the aiming device is shown in FIGS. 11-18 and generally designated 110. This embodiment is similar in construction, operation and function to the current embodiment above with several exceptions. For example, as shown in FIGS. 11-12, the aiming device 110 can include a body 120 with a protective frame 160 which includes a base 163, a first upright arm 161 and a second upright arm 162. The base, first arm and second arm can cooperatively form a viewing recess 169 within which the optical element 150 is at least partially disposed. The base 163 can extend laterally from a left side to a right side of the aiming device 110, generally crossing the longitudinal axis LA of the base and the aiming device in general. This longitudinal axis LA can generally bisect the sight 110 into corresponding left and right sides. The optical element 150 can be disposed in the viewing opening 169 defined in the frame and can include an optical axis OA that is parallel to and optionally coincident with the longitudinal axis. The primary dot 170 can be displayed on the optical element 150 like the embodiment above. The primary dot 170 can be produced by an illumination device 130 powered by a power source 139 similar to those described in the embodiment above.

The secondary alignment dots 140 of this embodiment, however, can take a different form from that of the current embodiment. For example, the secondary alignment dots 140 can be disposed distal from the optical element 150 and positioned, for example, in portions of the frame about the optical element 150. The secondary alignment dots also can be illuminated separately from the primary dot by other elements or components. As shown in FIGS. 11-12, a secondary alignment dot 141 can be disposed on a first upright arm 161 and a second secondary alignment dot 142 can be disposed in the second upright arm 162. Of course, the secondary alignment dots can be disposed elsewhere on the base or frame components and/or otherwise can be visible from different viewing perspectives of the user, rearward of the aiming device, depending on the application.

The secondary alignment dots 140 can project and can be visible along respective second viewing axes 2VA, which are offset from the optical axis OA, longitudinal axis LA, and the user viewing axis UVA, as those axes are described above. Being offset from the foregoing axes, the second viewing axes 2VA can be positioned and oriented to assist a user U in reconfiguring the aiming device from a misaligned mode to an aligned mode as described above, wherein in the aligned mode, the user can adequately view the primary dot 170 displayed on the optical element 150 within the user's field of view FOV and along a user's viewing axis, generally along the optical axis OA or close to it. In that aligned mode, as described above, a user can use the primary dot to satisfactorily engage a target with the weapon to which the aiming device 110 is attached.

Figure 13:
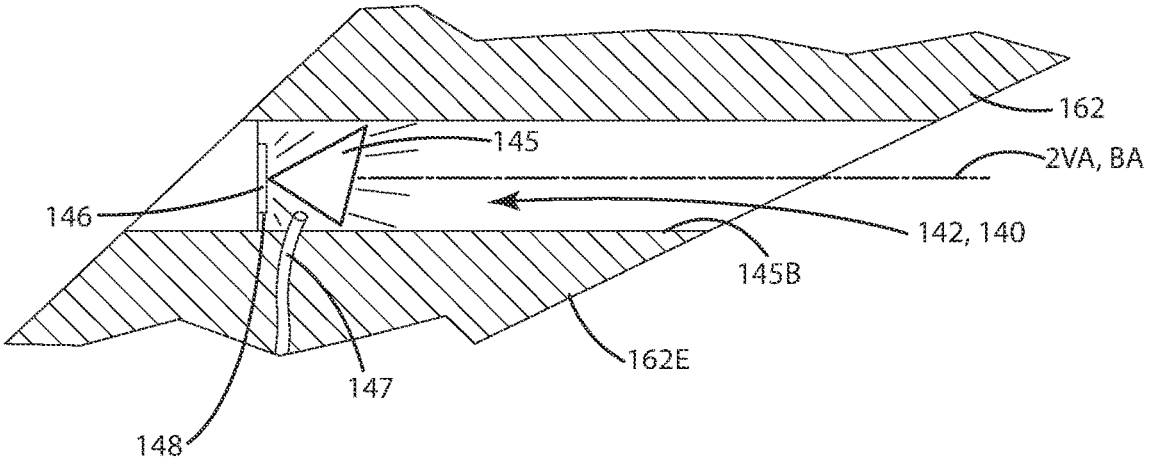
FIG. 13 is a section view of a secondary alignment dot thereof in the form of an illuminated element taken along line XIII-XIII of FIG. 11.

An exemplary construction of a secondary alignment dot 142 and optional features is illustrated in FIG. 13. Although only the construction of the secondary alignment dot 142 is described here, it will be appreciated that the other secondary alignment dot 141 can be substantially similar to this, except positioned on an opposing arm 161 rather than the arm 162. Further, it will be appreciated that similar types of alignment dots can be included in other portions of the frame, for example, the rearward portion of the frame, the sides of the frame distal from the arms, or and/or an overarching portion of the frame (not shown) that extends over the optical element 150 in a closed top reflex sight.

The secondary alignment dot 142 can optionally be an illumination device, and can project light along, or otherwise be visible along, a second viewing axis 2VA. The secondary alignment dot 142 can include a lens or a cover 145. This lens or cover can be a particular color, such as red or green, or of the wavelengths mentioned above. Optionally this lens can be of a color that is a different wavelength than that of the primary dot 170 so as to avoid confusion between the secondary alignment dot and the primary dot as described in the embodiment above. The secondary alignment dot 142 can include or comprise an illumination element 146 which can project illumination toward the lens or cover 145. Alternatively, the illumination element 146 can project a certain colored illumination therefrom, without the lens or cover 145 being present. The illumination device 146 can be in the form of a miniature LED. The illumination device 146 can be connected to the power source 139 as described in the current embodiment above via an electrical wire 148 that extends through the arm. In other cases, the illumination device 146 can be inductively coupled or otherwise in electrical communication with the power source 139.

Optionally, the illumination element 146 can be replaced by and/or supplemented with a fiber optic or light pipe 147 which can project light on the lens or cover (which are used interchangeably herein), or otherwise project illumination along the second viewing axis 2VA without a lens or cover disposed there over. In such a case, the fiber optic can be of a particular color, and can further optionally be of a different color than the primary dot.

As shown in FIG. 13, the secondary alignment dot 145 and its features can be disposed in recess 145B defined by the arm 162. This recess can be a cylindrical or polygonal shaped bore that extends from an exterior surface 162E of the arm 162 inward toward the optical element and/or toward the front of the aiming device. The recess 145B can include a bore axis BA that is coincident with the second viewing axis 2VA. This bore axis as well as the second viewing axis can be aligned at a transverse angle relative to the longitudinal axis LA, the optical axis OA the user viewing axis UVA and/or a primary viewing axis PVA that is used by a user to view the primary dot 170 in an aligned mode as described below.

The second viewing axis 2VA associated with each of the illustrated secondary alignment dots 141, 142 can be offset relative to the primary viewing axis PVA or optical axis OA. For example, each of the second viewing axes 2VA can be angularly offset relative to the first viewing axis PVA and optical axis OA as shown in the top view of the aiming device 110 in FIG. 14. There, the first viewing axis PVA or optical axis OA is angularly offset by an angle A1 relative to each of the second viewing axes 2VA, which as shown also can correspond to the bore axis BA of the bore associated with the respective secondary alignment dots 141, 142. This angle A1 can be optionally between 0° and 180°, between 1° and 179° inclusive, between 5° and 90° inclusive, between 5° and 85° inclusive, between 10° and 80° inclusive, between 15° and 75° inclusive, between 30° and 60° inclusive, about 30°, or about 45°. Of course, depending on where each of the secondary alignment dots 140 are located, this angle A1 can vary.

Further, in some applications, the respective secondary alignment dots 140 can be offset at different angles relative to the first viewing axis or optical axis. In addition, where some of the secondary alignment dots and their associated structures are disposed above, below and/or beyond corners of the optical element 150, the associated secondary viewing axes of those dots and their respective bore axes can be offset in different planes other than that shown in FIG. 14. For example, there can be a plane orthogonal to the view shown in FIG. 14 with which the optical axis is coincident. Secondary alignment dots above and/or below the optical element can project secondary viewing axes within that plane, into and out of the page of FIG. 14.

Figure 14:
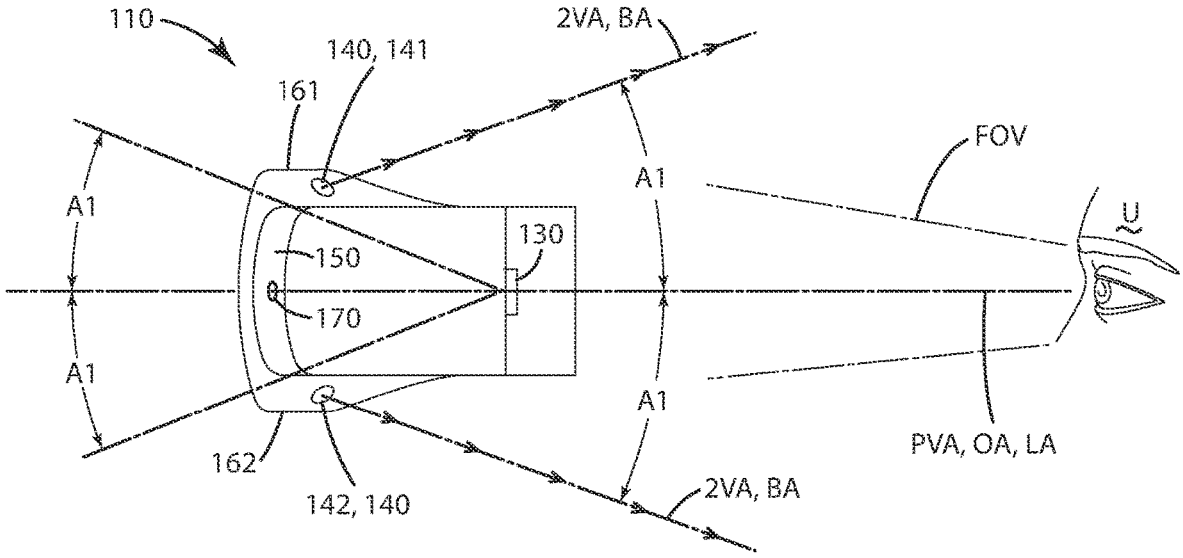
FIG. 14 is a top view of the aiming device of the first alternative embodiment illustrating a first viewing axis generally aligned with an optical axis in a field of view of a user so the user can view a primary dot displayed on an optical element of the aiming device, and the aiming device is in an aligned mode.

Optionally, the secondary alignment dots 141 and 142 cannot be viewed simultaneously. The secondary alignment dots will visible to a user in a user's field of view FOV only when the eyes of the user U, shown in FIG. 14 are aligned with a particular secondary viewing axis and/or bore axis. When the users primary or first viewing axis PVA is aligned with the aiming device 110, for example, generally parallel to the optical axis OA, such that the user sufficiently can view the primary dot 170, the user typically will not be able to view the secondary alignment dots 141 or 142 because the user's eyes will not be aligned with the secondary viewing axes of the respective secondary alignment dots 141 142.

Methods of using the aiming device 110 of the first alternative embodiment are shown generally in FIGS. 14-18. FIG. 14 illustrates an aligned mode, similar to the aligned mode described above, where the users field of view FOV is oriented such that there first viewing axis or primary viewing axis PVA is generally aligned with the optical axis OA of the optical element and/or such that the user U can view the primary dot 170 displayed in the optical element. In this aligned mode, the user can further align the primary dot 170 with a target as described in the embodiment above and engage the target satisfactorily. In this aligned mode, the user's field of view FOV, and more particularly their first viewing axis or primary viewing axis PVA is not aligned with or parallel to the secondary second viewing axis 2VA of either of the secondary alignment dots 140. Therefore, the user U does not perceive or view those secondary alignment dots. Again this can be because the secondary viewing axes 2VA are offset from the primary viewing axis PVA by the offset angle A1 as shown in FIG. 14.

Figure 15:
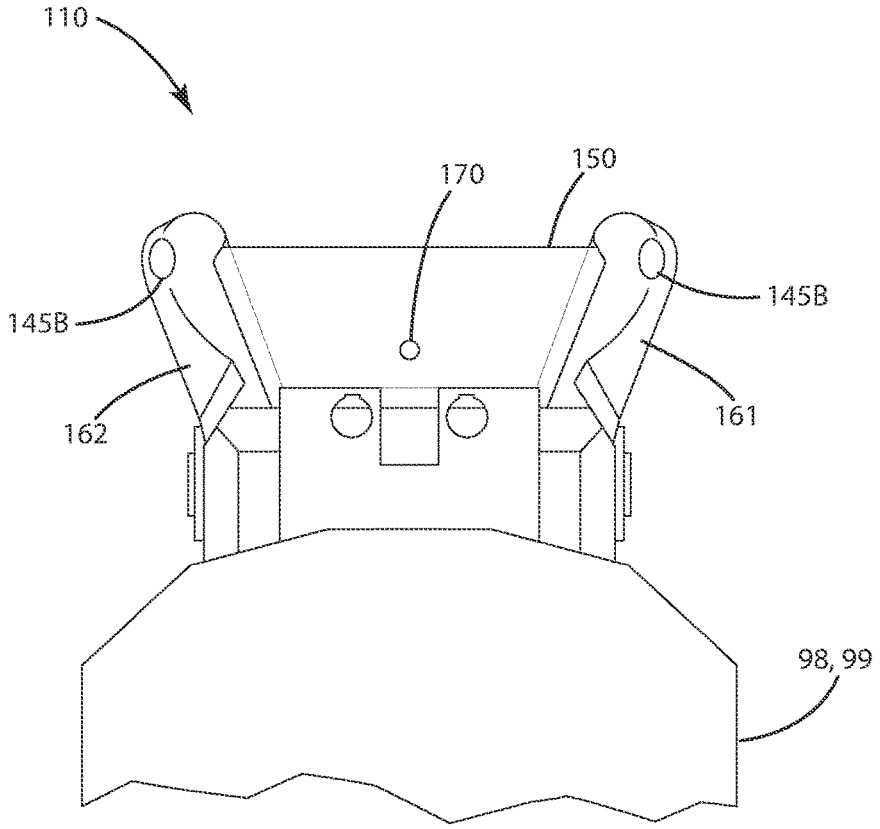
FIG. 15 a rear view of the aiming device of the first alternative embodiment in an aligned mode, with the primary dot visible to a user in a field of view of the user.

The view of the user U toward the rear of the aiming device 110 in the aligned mode is shown in FIG. 15. There, the user's first viewing axis or primary viewing axis PVA is generally aligned with the optical axis OA of the optical element 150 such that the user can satisfactorily view the primary dot 170 displayed relative to the optical element 150. In this aligned mode, the muzzle 99 is generally aligned forward of the remainder of the slide 98 and firearm. From this view, it also is evident that the secondary alignment dots 141, 142 are not visible to the user U. Instead, only the respective recesses 145B associated with the respective secondary alignment dots 141, 142 in the respective upright arms 161, 162 are visible. Again, because the recesses, their axes and the second viewing axes of the respective secondary alignment dots are angularly offset relative to the first viewing axis UVA, the secondary alignment dots 141 and 142 are not visible, and can be concealed by portions of the upright arms 161, 162 and the bores in general.

Figure 16:
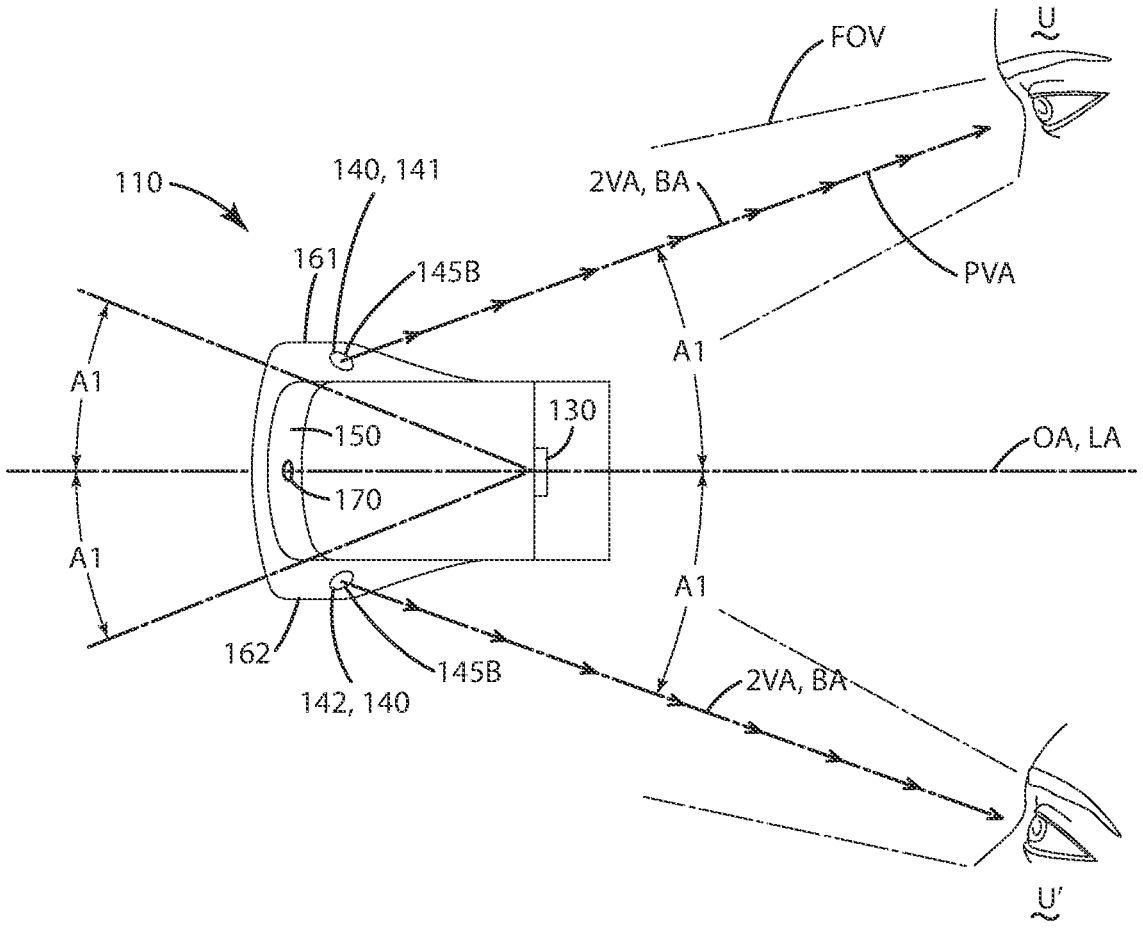
FIG. 16 is a top view of the aiming device of the first alternative embodiment illustrating the aiming device in an exemplary first misaligned mode, with the primary dot not visible to a user in a field of view, and a secondary alignment dot visible along a second viewing axis thereof to provide instruction to the user to move the aiming device and gain or improve visibility in the user's field of view of the primary dot.
Figure 17:
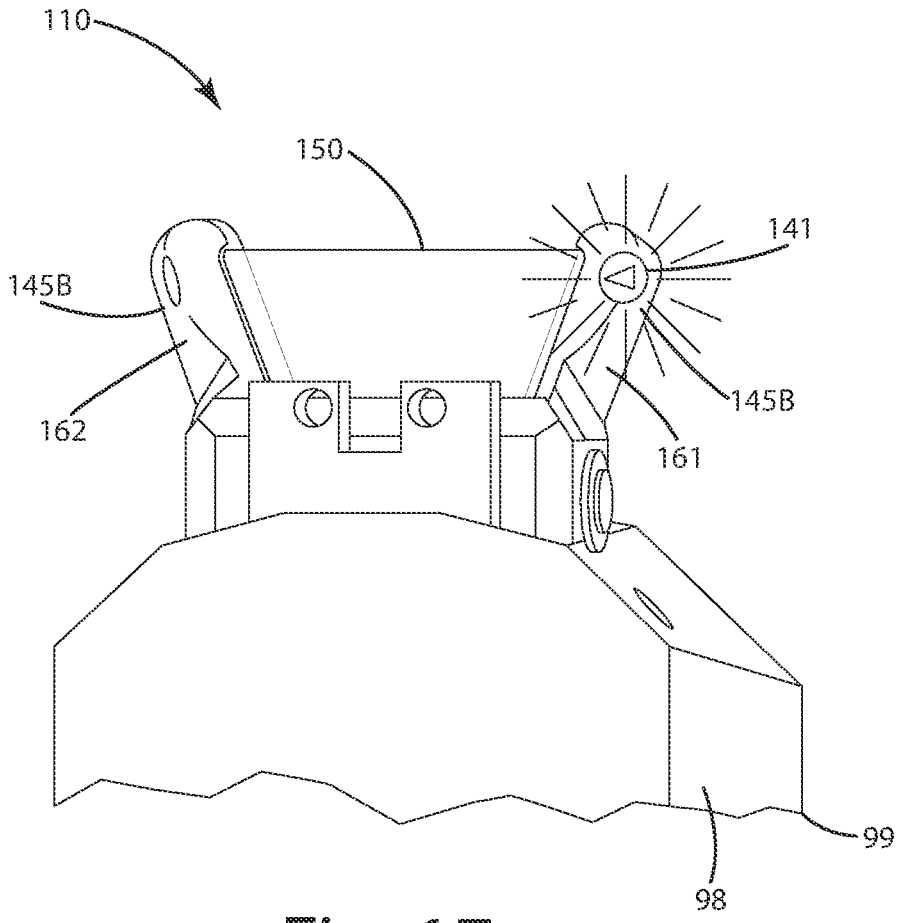
FIG. 17 is a rear view thereof.

FIGS. 16 and 17 illustrate an exemplary misaligned mode of the aiming device and firearm in general. As shown in FIG. 17, the muzzle 99 is oriented too far to the right relative to the rearward portion and slide of the firearm. The aiming device 110 thus is perceived by a user as shown there. As evident from the top view of FIG. 17, the primary dot 170 cannot be viewed from the field of view FOV of the user U. However, the user's primary viewing axis PVA is more aligned with the second viewing axis 2VA associated with the secondary alignment dot 141 and its respective bore 145B on the first upright arm 161. Thus, the user's primary viewing axis is offset at the angle A1 or a range of angles A1 relative to the optical axis OA. Again, with this offset, the user cannot view the primary dot 170 displayed on the optical element 150. The user, however, perceives the secondary alignment dot 141 as shown in FIG. 17. Upon viewing this secondary alignment dot 141 in this misaligned mode, the user perceives the general instruction provided by that secondary alignment dot which is in the form of an arrow or pointer, pointing generally to the left of the page in FIG. 17. As a result, this provides instruction to the user to correspondingly move the muzzle 99 of the weapon to the left in FIG. 17. This can convert the aiming device from the misaligned mode shown in FIG. 17 to the aligned mode shown in FIG. 15. As the muzzle 99 moves, the primary dot 170 comes into view and the bore, bore axis and secondary viewing axis 2VA become misaligned and offset relative to the first viewing axis or primary viewing axis PVA of the user such that the secondary alignment 141 is no longer visible after the user acquires a view of the primary dot 170 as shown in FIG. 15.

Figure 18:
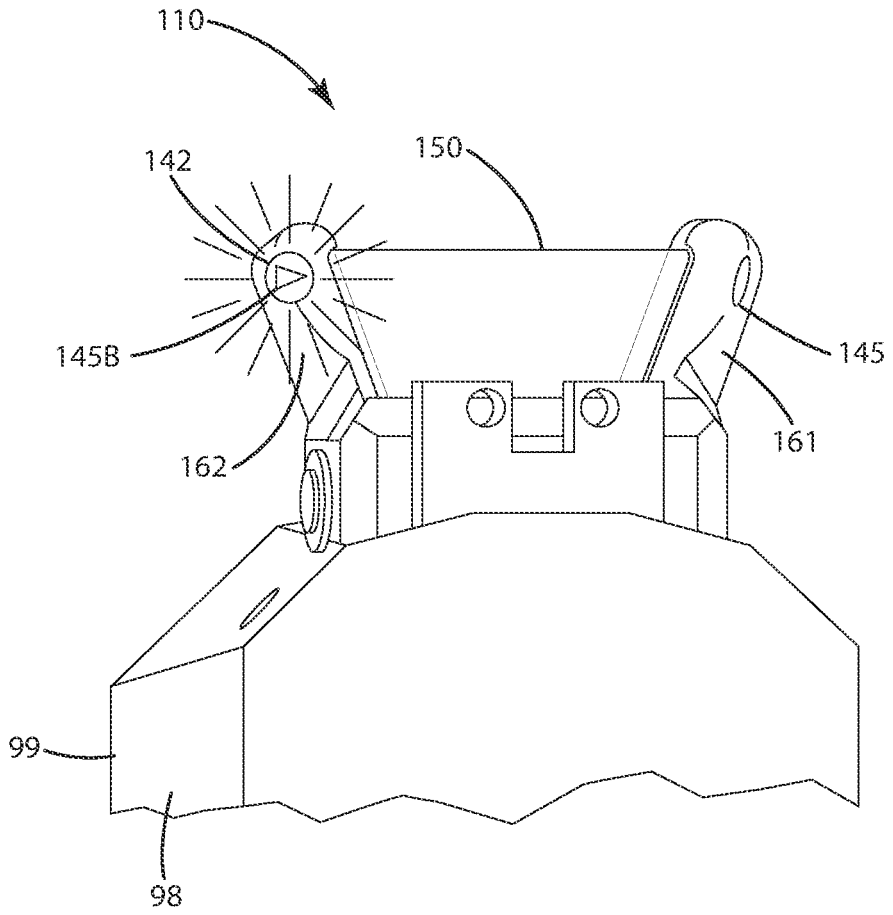
FIG. 18 is a rear view of the aiming device of the first alternative embodiment illustrating the aiming device in an exemplary second misaligned mode.

FIGS. 16 and 18 illustrate another exemplary misaligned mode of the aiming device and firearm in general. As shown in FIG. 18, the muzzle 99 is oriented too far to the left relative to the rearward portion and slide of the firearm. The aiming device 110 thus is perceived by a user in the user's field of view in the configuration shown in FIG. 18. There, the user again cannot perceive the primary dot 170, and thus cannot aim at a target. This is similar to the misaligned mode described above in connection with FIG. 17. For example, as shown in FIG. 16, the user U' now perceives the left secondary alignment dot 142 because the user's primary viewing axis is aligned with the second viewing axis 2VA and bore axis BA of the secondary alignment dot 142. This secondary alignment dot 142, in the orientation shown in FIG. 18 again provides the user with visual feedback or instruction, pointing in the direction which the muzzle 99 must be moved, that is, to the right. After the user moves the muzzle as instructed by the secondary alignment dot 142, the aiming device is converted back to the aligned mode shown in FIG. 15. The user can then proceed with aligning the primary dot 170 with a target.

The following additional statements are provided, the numbering of which is not to be construed as designating levels of importance.

Statement 1. An aiming device comprising: a body having a front, a rear and opposing sides, the rear configured to face toward a user during use of the aiming device, the body including a frame; an illumination device housed in the body; an optical element joined with the body such that the frame extends at least partially around the optical element; and a secondary alignment dot located distal from the optical element, the secondary alignment dot joined with the frame, wherein the illumination device is operable to display a primary dot relative to the optical element that is visible to a user along a first viewing axis projecting from the rear of the body, wherein the primary dot is visible to the user within a field of view of the user along the first viewing axis, but the secondary alignment dot is not visible to the user, within the field of view of the user, when the aiming device is in an aligned mode, wherein the secondary alignment dot is visible to the user within the field of view of the user, when the aiming device is in a misaligned mode, so as to provide instruction to the user to realign the aiming device relative to the field of view of the user.

Statement 2: The aiming device of Statement 1, wherein the secondary alignment dot includes an illumination element that emits a first illumination therefrom, the first illumination being in a first visible wavelength range, wherein the primary dot is displayed on the optical element in a second visible wavelength range different from the first visible wavelength range.

Statement 3: The aiming device of Statement 2, wherein the secondary alignment dot is disposed in a recess and/or bore defined in at least one of the body and the frame, wherein the illumination element is disposed in the recess, below an exterior surface of the at least one of the body and the frame, whereby the user cannot see the illumination element when the user is viewing along a line parallel to the exterior surface, and/or viewing the primary dot.

Statement 4: The aiming device of claim Statement 1, wherein the recess is a bore that includes a bore longitudinal axis, wherein the bore longitudinal axis is offset at an angle between 5° and 85° inclusive, relative to an optical axis of the optical element, when viewed from a top view of the aiming device.

Statement 5: The aiming device of Statement 4, wherein the bore extends at least 1 mm below the exterior surface, wherein the secondary alignment dot is adjacent at least one of a right side and a left side of the body, on a respective first and second upright side of the frame.

Statement 6: The aiming device of Statement 1, wherein the primary dot is not visible to the user when the user is viewing the secondary alignment dot along the second viewing axis in the misaligned mode, wherein the primary dot is obscured by at least one of the body and the frame when the user is viewing the secondary alignment dot along the second viewing axis.

Statement 7: The aiming device of Statement 1, wherein the secondary alignment dot is a first secondary alignment dot and comprising a second secondary alignment dot distal from the first secondary alignment dot, wherein the first secondary alignment dot is not simultaneously viewable with the second secondary alignment dot.

Statement 8: The aiming device of Statement 7, wherein the first secondary alignment dot is viewable along a left second viewing axis, wherein the second secondary alignment dot is viewable along a right second viewing axis, wherein the left second viewing axis and write second viewing axis are each offset at equal angles from the first viewing axis.

Statement 9: An aiming device comprising: a body including a frame; an illumination device housed in the body; an optical element joined with the frame; a secondary alignment dot located distal from the optical element, wherein the illumination device is operable to display a primary dot on the optical element such that the dot is visible to a user along an optical axis from a rear of the body, wherein the secondary alignment dot is operable to emit illumination along a second viewing axis that is offset from the optical axis, wherein the primary dot is visible to the user but the secondary alignment dot is not visible to the user with the aiming device is in an aligned mode, wherein the secondary alignment dot is visible to the user but the primary dot is not visible to the user when the aiming device is in a misaligned mode.

Statement 10: The aiming device of Statement 9, wherein the optical element is a lens, wherein the primary dot is at least one of a circular shaped dot, a pattern, a reticle and a sight indicia, wherein the secondary alignment dot includes an LED that projects illumination toward another lens disposed in a recess or bore defined by an upright portion of the frame is disposed to at least one of a left side and a right side of the optical element.

Statement 11: The aiming device of Statement 10, wherein the recess or bore is an elongated bore having a bore longitudinal axis, wherein the bore longitudinal axis is angularly offset relative to an optical axis of the optical element, wherein the second viewing axis is angularly offset from the optical axis.

Statement 12: An aiming device comprising: a body including a frame; an optical element joined with the body, the optical element having selectively displayed thereon a primary dot that is visible to a user along a first viewing axis in an aligned mode; and a secondary alignment dot located distal from the optical element and not displayed thereon, the very alignment dot visible along a second viewing axis that is offset from the first viewing axis in a misaligned mode, in which the primary dot is not visible to the user along the first viewing axis, the secondary alignment dot providing instruction to a user regain or attain visibility of the primary dot.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

What is claimed is:

1. A sight comprising:

a body;

a light source in the body;

a power source in electrical communication with the light source; and an optical element aligned with the light source;

wherein the light source projects a primary dot and a secondary alignment dot in a projection region, wherein the primary dot is visible to a user within a field of view of the user, but the secondary alignment dot is not visible to the user, within the field of view of the user, when the sight is in an aligned mode, wherein the secondary alignment dot is visible to the user within the field of view of the user, when the sight is in a misaligned mode, so as to provide instruction to the user to realign the sight relative to the field of view of the user so that the user can aim the primary dot at a target, wherein the primary dot and the secondary alignment dot are simultaneously projected in the projection region in the aligned mode, wherein the secondary alignment dot is in the form of a reticle pattern, wherein the reticle pattern extends around the primary dot in the projection region.

2. The sight of claim 1, wherein the primary dot includes a primary viewing axis that projects rearward from the optical element, wherein the secondary alignment dot is not visible to the user in the field of view of the user, when the sight is in the aligned mode, but the secondary alignment dot is still projected in the projection region with the primary dot, in the aligned mode.

3. The sight of claim 1, wherein the reticle pattern is not visible to the user when the sight is in the aligned mode and the primary dot is in the field of view.

4. The sight of claim 1, wherein the optical element includes a curved reflective surface;

wherein the light source projects illumination toward the curved reflective surface.

5. A sight comprising:

a body;

a light source in the body;

a power source in electrical communication with the light source; and an optical element aligned with the light source;

wherein the light source projects a primary dot and a secondary alignment dot in a projection region, wherein the primary dot is visible to a user within a field of view of the user, but the secondary alignment dot is not visible to the user, within the field of view of the user, when the sight is in an aligned mode, wherein the secondary alignment dot is visible to the user within the field of view of the user, when the sight is in a misaligned mode, so as to provide instruction to the user to realign the sight relative to the field of view of the user so that the user can aim the primary dot at a target, wherein the primary dot and the secondary alignment dot are simultaneously projected in the projection region in the aligned mode, wherein the secondary alignment dot includes a plurality of arrows that surround the primary dot, wherein a first arrow is visible to the user, but a second arrow is not visible to the user within the field of view, when the sight is in the misaligned mode, but while the first and second arrows are both projected in the projection region.

6. A sight comprising:

a body;

a light source in the body;

a power source in electrical communication with the light source; and an optical element aligned with the light source;

wherein the light source projects a primary dot and a secondary alignment dot in a projection region, wherein the primary dot is visible to a user within a field of view of the user, but the secondary alignment dot is not visible to the user, within the field of view of the user, when the sight is in an aligned mode, wherein the secondary alignment dot is visible to the user within the field of view of the user, when the sight is in a misaligned mode, so as to provide instruction to the user to realign the sight relative to the field of view of the user so that the user can aim the primary dot at a target, wherein the primary dot and the secondary alignment dot are simultaneously projected in the projection region in the aligned mode, wherein the secondary alignment dot is configured to provide instruction to realign the sight in a sideways direction in the misaligned mode, whereby the primary dot appears from a left or right side of the optical element in transitioning from the misaligned mode to the aligned mode, wherein the secondary alignment dot is a reticle pattern that surrounds the primary dot.

7. A sight comprising:

a body;

a light source in the body;

a power source in electrical communication with the light source; and an optical element aligned with the light source;

wherein the light source projects a primary dot and a secondary alignment dot in a projection region, wherein the primary dot is visible to a user within a field of view of the user, but the secondary alignment dot is not visible to the user, within the field of view of the user, when the sight is in an aligned mode, wherein the secondary alignment dot is visible to the user within the field of view of the user, when the sight is in a misaligned mode, so as to provide instruction to the user to realign the sight relative to the field of view of the user so that the user can aim the primary dot at a target, wherein the primary dot and the secondary alignment dot are simultaneously projected in the projection region in the aligned mode, wherein the optical element includes a rearward facing surface area, wherein the projection region is larger than the rearward facing surface area, such that the secondary alignment dot is projected beyond the rearward facing surface area in the aligned mode.

8. A sight comprising:

a body;

a light source joined with the body;

a protective frame joined with the body;

a reflective optical element in the protective frame;

wherein the light source projects a primary dot and a secondary alignment dot simultaneously in a projection region in both an aligned mode and a misaligned mode, wherein in the aligned mode the primary dot is reflected from the reflective optical element and is visible to a user along a primary viewing axis within a field of view of the user, but the secondary alignment dot is not visible to the user within the field of view of the user, even though the secondary alignment dot is simultaneously in the projection region with the primary dot, wherein in the misaligned mode, the secondary alignment dot is reflected from the reflective optical element and is visible to the user within the field of view of the user, when the sight is in a misaligned mode, even while the primary dot is being projected in the projection region, wherein the secondary alignment dot visible in the misaligned mode provides instruction to the user to realign the sight relative to the field of view of the user so that the sight can be transitioned to the aligned mode, wherein the primary dot and the secondary alignment dot are reflected from a single reflective optical element.

9. The sight of claim 8, wherein the secondary alignment dot leaves the field of view and is no longer visible when the user realigns the sight to transition to the aligned mode.

10. A sight comprising:

a body;

a light source joined with the body;

a protective frame joined with the body;

a reflective optical element in the protective frame;

wherein the light source projects a primary dot and a secondary alignment dot simultaneously in a projection region in both an aligned mode and a misaligned mode, wherein in the aligned mode the primary dot is reflected from the reflective optical element and is visible to a user along a primary viewing axis within a field of view of the user, but the secondary alignment dot is not visible to the user within the field of view of the user, even though the secondary alignment dot is simultaneously in the projection region with the primary dot, wherein in the misaligned mode, the secondary alignment dot is reflected from the reflective optical element and is visible to the user within the field of view of the user, when the sight is in a misaligned mode, even while the primary dot is being projected in the projection region, wherein the secondary alignment dot visible in the misaligned mode provides instruction to the user to realign the sight relative to the field of view of the user so that the sight can be transitioned to the aligned mode, wherein the secondary alignment dot is in the form of a reticle pattern, wherein the reticle pattern is arranged around the primary dot in the projection region.

11. The sight of claim 10, wherein the reticle pattern is not visible to the user when the sight is in the aligned mode and the primary dot is in the field of view.

12. A method of operating a sight, the method comprising:

projecting a primary dot and a secondary alignment dot simultaneously in a projection region that overlaps an optical element in both an aligned mode and a misaligned mode;

making the primary dot visible to a user within a field of view of the user along a primary axis, but the secondary alignment dot not visible to the user within the field of view of the user, when the sight is in the aligned mode;

making the secondary alignment dot visible to the user within the field of view when the primary dot is not visible to the user within the field of view of the user along the primary axis, when the sight is in the misaligned mode; and instructing the user with the secondary alignment dot to move the sight so that the primary dot comes into the field of view so that the primary dot is visible to the user within the field of view and the sight transitions from the misaligned mode to the aligned mode.

13. The method of claim 12, wherein the user can align the primary dot in the projection region with a target in the aligned mode, while simultaneously, the secondary alignment dot is in the projection region, but not visible to the user.

14. The method of claim 12, wherein the instructing step includes instructing the user with the secondary alignment dot to move the sight left so the primary dot comes into the field of view.

15. The method of claim 12, wherein the instructing step includes instructing the user with the secondary alignment dot to move the sight right so the primary dot comes into the field of view.

16. The method of claim 12, comprising:

reflecting the primary dot from the optical element in the aligned mode, while simultaneously maintaining the secondary alignment dot in the projection region; and reflecting the secondary alignment dot from the optical element in the aligned mode, while simultaneously maintaining the primary dot in the projection region.

* * * * *